US005547013A

United States Patent [19]

Sherwood

[11] Patent Number: 5,547,013

[45] Date of Patent: Aug. 20, 1996

[54] ROTARY WHEEL CASTING MACHINE

[76] Inventor: William L. Sherwood, 7249 Cypress Street, Vancouver, B.C. V6P 5M2, Canada

[21] Appl. No.: 419,114

[22] Filed: Apr. 10, 1995

Related U.S. Application Data

[63] Continuation-in-part of Ser. No. 308,539, Sep. 21, 1994, abandoned, which is a continuation-in-part of Ser. No. 33,605, Mar. 17, 1993, abandoned.

[51] Int. Cl.[6] ..... B22D 11/06

[52] U.S. Cl. ..... 164/416; 164/429; 164/442; 164/443; 164/444

[58] Field of Search ..... 164/427, 429, 164/443, 444, 416, 342, 442

[56] References Cited

U.S. PATENT DOCUMENTS

| | | | |
|---|---|---|---|
| 441,643 | 12/1890 | Close | 164/429 X |
| 3,659,643 | 5/1972 | Pavels | 164/416 |
| 4,589,470 | 5/1986 | Bedell et al. | 164/443 X |

FOREIGN PATENT DOCUMENTS

| | | | |
|---|---|---|---|
| 1301977 | 7/1962 | France | 164/429 |
| 58-205660 | 11/1983 | Japan | 164/416 |
| 59-127955 | 7/1984 | Japan | 164/429 |
| 60-72651 | 4/1985 | Japan | 164/429 |
| 908493 | 2/1982 | U.S.S.R. | 164/429 |

*Primary Examiner*—J. Reed Batten, Jr.

[57] ABSTRACT

A casting wheel carries a rotating inner-radius mold wall along its rim and features a non-rotating mold segment incorporating the outer-radius mold wall, circumferentially oscillated about an external stationary support. The casting wheel includes circumferential guide tracks around the wheel periphery, along which cam guide rollers carrying the non-rotating segment act to maintain a closely controlled interface clearance between the inner and outer-radius mold wall edges throughout the rotation. The non-rotating mold segment may be constructed as a single box or multiple box segments hinged together for oscillation by a single oscillator, each segment incorporating its own guide roller system. Each box inside wall doubles as the mold envelope outside wall, against which water sprays may be directed from nozzles within the box enclosure, which is drained by gravity from an outlet proximate the lower end. Because of the rigid construction of both wheel and closure, wide slab sections for flat-rolled products can be cast by simply increasing the width of the wheel in relation to the depth of the mold envelope. Adjustable-width side dams can be used for adjusting cast slab width, extra clearance for entry of submerged shrouds for casting of this slab sections, and is adaptable for a variety of near net shape products including structural sections. Box enclosures carrying a series of idler rollers can be used in place of the outer-radius mold wall, following the formation of a cohesive solid skin on the section being cast. This eliminates significant closure friction and assures non-sliding contact at controlled pressure between stock and wheel, thereby propelling the stock by static friction along the arc of contact with the wheel, rather than by pulling with withdrawal rollers following discharge, or with driven rollers along the containment section. A mechanical-hydraulic oscillator transmission can be employed to accomplish the rapid oscillation characteristic of high speeds of continuous casting.

31 Claims, 15 Drawing Sheets

ROTARY WHEEL CASTING MACHINE

This application is a continuation-in-part of application Ser. No. 08/308,539 filed Sep. 21, 1994 which in turn is a continuation-in-part of application Ser. No. 08/033,605 filed Mar. 17, 1993, both now abandoned.

The invention relates to the continuous casting of steel and other metals and, more particularly, to an improved rotary wheel-type casting machine for continuous casting of billets blooms, slabs, bars rods and the like.

In the prior art of vertical continuous casting wheels, peripheral closure of the casting mold channel generally is accomplished by either a moving, endless metal belt pressed against the wheel rim by rollers to realize closure and synchronous peripheral motion with the wheel, or by multiple closure segments, or clamshell-style molds, spaced in abutting sectors around the entire wheel circumference and rotating with it, which are closed proximate the point of pouring steam entry, and reopened at bar exit from the casting sector during each revolution of the wheel. Known technology also includes a stationary closure belt, pressed in frictional contact against the wheel periphery spanning the casting arc.

Disadvantages of the endless belt include: heat from the casting warps the belt, also imparting a wrinkled and warped surface to the cast stock on the belt side of the section; return rollers are bulky and occupy useful space; a closed and sealed collector and conduit for spent belt-cooling water is difficult, if not impossible, to realize; belts require a regular schedule of replacement through wear and warpage; belts do not maintain uniform contact and pressure to hold the casting firmly against the wheel as the casting proceeds around the wheel; and maximum width of cast stock is very limited due to belt flexure and warpage. Despite these disadvantages, most commercial production machines employ a moving endless flexible metal belt to effect mold closure.

Disadvantages of segmented molds include mechanical complexity with inherently very large number of cooperating parts and components; difficulty in maintaining necessary close tolerances between large number of interacting wheel sectors usually 24 or 36, each sector including a clam-shell mold pair, inlet-outlet water piping, mechanical hinging and actuation; problems with metal and slag splashes interfering with mold closure and mold-mold interfaces; and additional tundish pouring clearance necessary to accommodate individual mold sector height above metal meniscus.

Disadvantages of the static closure are incidence of sticking between the moving surface of the initially solidified stock and the stationary surface of the closure, resulting in possible skin ruptures and the like; also wear and operating problems associated with contact friction between wheel perimeter surface and the closure surface.

Casting wheels having an oscillating closure have also been proposed. These have not offered practical support of the oscillating casting shoe assembly along with close control of the clearance dimension between channel edge surfaces and the mating edges of the oscillating shoe, or a low-inertia closure assembly allowing rapid oscillation, in combination with close clearance control. Further, the prior art lacks means for precise positioning of containment rollers relative to the wheel rim, along with control of the containment roller pressure against the cast section below the mold, together with capture and disposal of spent coolant, as an integral part of the wheel assembly, rather than of a bulky external structure without coolant capture. Practical means for changing the width of cast slab sections, without changing molds, is also not evident in the prior art of rotary wheel casters.

It is a principal object of this invention to provide a rotary wheel continuous casting machine which does not have the disadvantages cited above for prior art casting wheels.

Another object is to provide a casting machine which realizes a much higher output per strand of equivalent cross-section than do conventional vertical, curved or horizontal casting machines, and thereby can involve less cost and complexity for equivalent output.

A further object is to provide, in various embodiments, a casting machine capable of casting billet and bloom type sections for rolling into rod, bar and tubing sections and, in a modified embodiment, flat slab sections suitable for subsequent rolling into plate, sheet and strip products, with the invention particularly suitable for casting near net shape products such as thin slabs and beam blanks. Varying the width of slab section without changing the wheel channel is a related object.

An additional object is to provide a casting machine in which the principal force and pressure propelling the cast section forward is inherently effected at the location of the cross section being cast, rather than by the pulling force and tension created by the withdrawal pinch rollers following exit from the casting mold and containment spray chamber area, thus eliminating the main source of skin stresses and tears with associated substantial increase in casting rate.

A still further object is to provide a casting machine capable of casting product with very good surface and internal metallurgical quality.

The invention comprises basic features in common with the prior art, namely a rotary wheel continuous casting machine comprising a rotary wheel incorporating a circumferential inner-radius mold wall with two parallel annular inner mold-wall edges, integral to the wheel rim; a non-rotating casting-mold segment incorporating an outer-radius mold wall having two outer mold-wall edges which are parallel to, and interface with, said inner mold-wall edges, forming a casting mold envelope between said inner and outer-radius mold walls; molten metal pouring means adapted for introducing molten metal proximate the entry end of said mold envelope to pass through in the casting direction of circular wheel rotation and at least partially solidify a cast metal section for exit from the exit end of said mold envelope; external support means of said non-rotating segment adapted to maintain it in a substantially fixed angular position in relation to said wheel; reciprocal oscillation means connected to said non-rotating casting-mold segment adapted to effect relative annular oscillation movement of said outer radius mold wall alternately in said casting and reverse directions in relation to said support means and thereby between said outer-radius mold wall and said solidifying cast section, the invention comprising combination of these with: at least one annular outer-radius mold-wall edge guide track integral to said rotary wheel proximate the wheel rim and which is parallel to said parallel mold-wall edges; and at least one guide track follower fixed to said non-rotating casting segment which is maintained in contact with said guide track during rotation of said wheel, adapted to maintain a substantially constant dimensional clearance between said inner-radius and outer-radius mold-wall edges.

A preferred embodiment includes two of said guide tracks, one located on either side of the central plane of rotation of said inner-radius mold wall, and at least two of said followers for each of said guide tracks, and said followers comprise cam roller followers which run in contact with said track and incorporate means of restraining relative movement in the axial as well as radial direction of said cam roller followers relative to said track and thereby between said inner and outer mold-wall edges during wheel rotation.

The radially guiding surfaces of each said guide track typically face radially outwards from the rotation axis of said wheel, and said cam follower rollers ride on these surfaces and thereby do not restrain said casting-mold segments from movement in the radially outward direction. In one embodiment, the wheel carries another annular balancing guide track with faces directed radially inwards, complementary to each outward-facing track, against which rides at least one balancing cam follower attached to said non-rotating casting-mold segment thereby maintaining contact between said guide track followers and said guide track by radially restraining movement of said casting mold segment in the direction radially outwards from said wheel. In another embodiment, the casting mold segments also carry a supplementary guide track against which fluid-pressure loaded balancing cam followers maintain continuous pressure and contact of the guide track followers against the wheel rim, with the balancing followers, in turn, being supported and positioned from a fixed support of the machine housing, or the like. The supplementary track preferably includes a reverse capturing flange for the balancing follower, enabling the casting segments to be lifted off the wheel and held in suspension during inspection or maintenance.

The non-rotating casting mold segment most suitably comprises a rigid, semicircular box enclosure having two box side walls, a box outer cover wall and a box inner wall carrying said outer-radius mold wall on its face, or multiple box enclosures hinged together at their ends, in which said external support means and said oscillation means are attached to the box enclosure, thereby being adapted to oscillate said outer-radius mold wall back and forth in the circumferential direction about a substantially fixed angular location on the casting wheel periphery. Spray nozzles are suitably contained within said box enclosure directed radially inwards, to spray coolant directly against said outer-radius mold walls and spent coolant is confined within the box enclosure and discharged via an appropriate outlet duct. Alternatively, the box enclosure may form a pressurized water jacket, internally baffled to provide an annulus for flow of pressurized coolant against the mold-wall. Appropriately, there are four studded cam roller track followers, with two mounted to project outwardly from each box side wall, and two balancing cam roller assemblies, one mounted on the outside of each box side wall intermediate between said track followers, including means for applying a continuous controlled pressure of the balancing rollers against the tracks, sufficient to maintain the guide track followers in continuous contact with the outward-facing guide track.

Another aspect of the invention provides a containment-roller segment adjoining the mold envelope exit end, similar to the casting mold segment but carrying transverse containment idler rollers journalled in bearings supported by the box side walls, with faces positioned and adapted to press radially inwards against the outer face of the section of stock being east to maintain the inner face of the section pressed against the inner-radius mold wall, the tangential component of this pressure acting to exert a circumferential forward propelling force on the stock in the casting direction. Means are provided for controlling the radial movement and pressure of those rollers against the face of the section being east.

Other aspects of the invention include apparatus for positioning of movable side-dam bars adapted for varying the width of the metal section being cast; a tangential departure of the outer mold-wall at the entry end of the mold envelope to provide improved access for introducing liquid metal; and a mold closure guiding arrangement applicable to spray-cooled solid-block copper casting wheel mold rings.

Various other objects, features and advantages of the process and apparatus of this invention will become apparent from the following detailed description and claims, and by referring to the accompanying drawings, in which:

Figure 1:
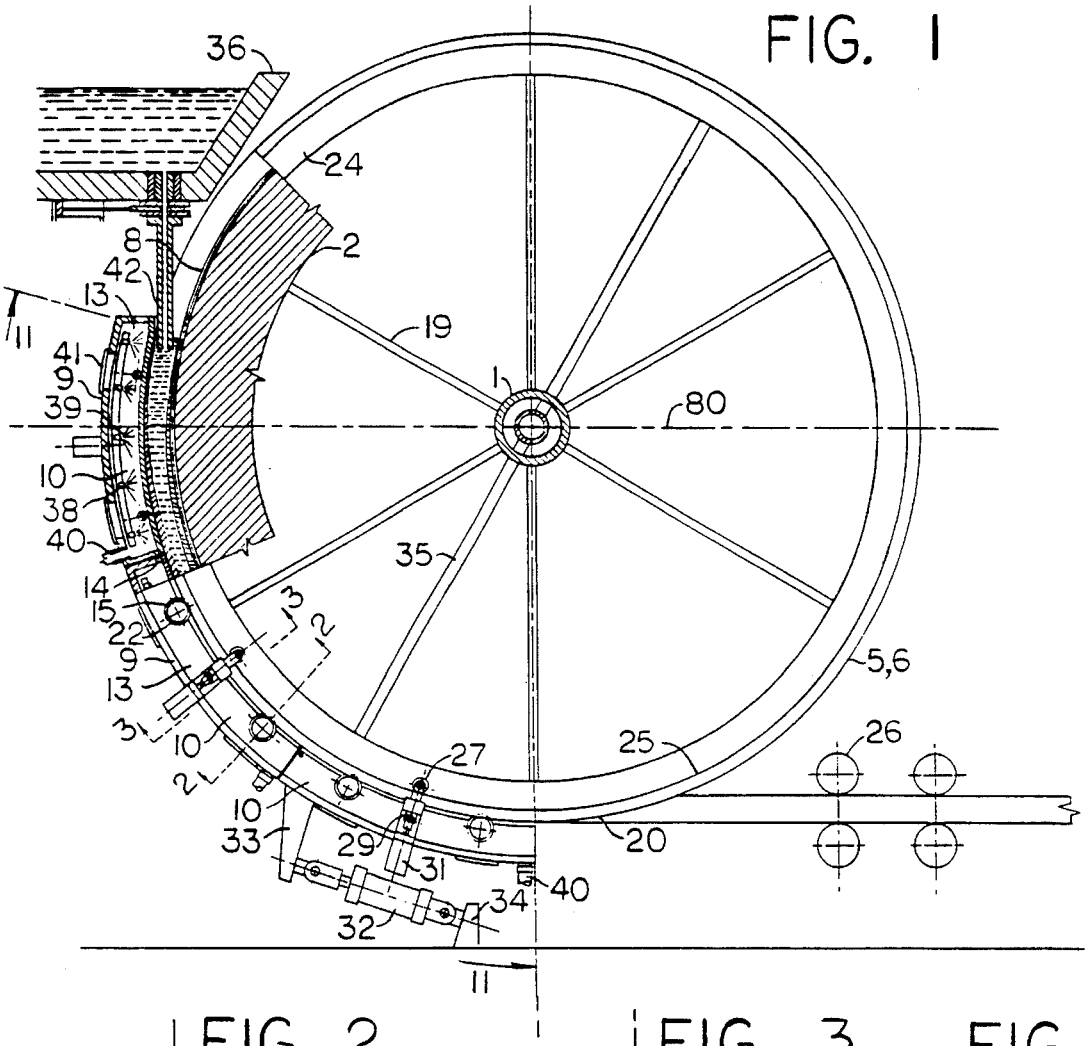
FIG. 1 is an illustrative side view of a rotary wheel casting machine embodiment according to the invention, including a wheel sector illustrated in section, along the plane of rotation intersecting the mold center line.
Figure 2:
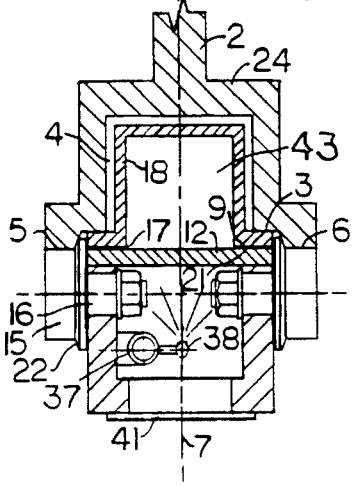
FIG. 2 is a section view along plane 2—2 of FIG. 1 incorporating a mold cavity of general shape suitable for the casting of blooms, billets, bars and rods applicable to production of long products.
Figure 5:
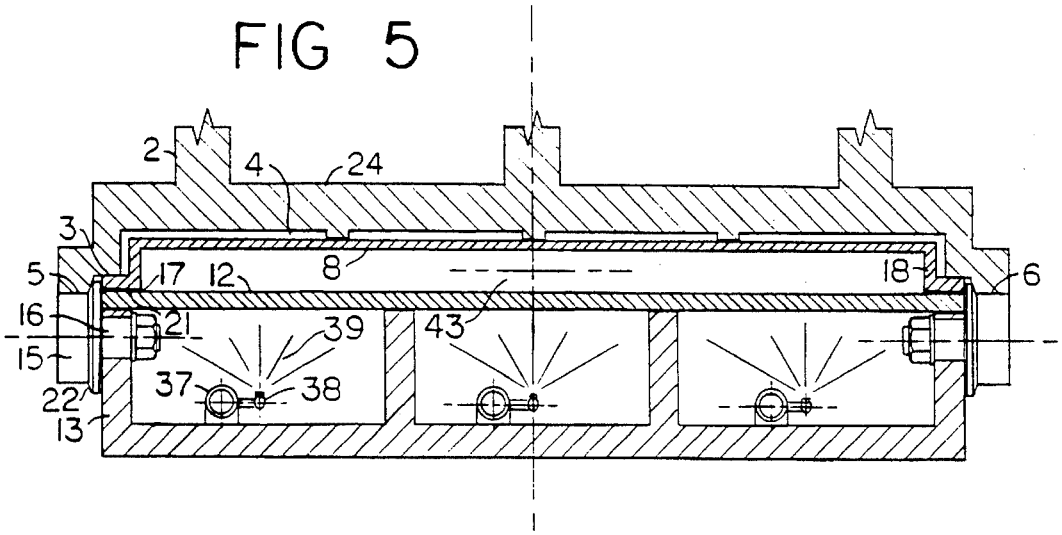
FIG. 5 is a corresponding section view to that illustrated in FIG. 2 incorporating a mold cavity of general shape suitable for casting slabs, plates, sheets and strip, as applicable to the production of flat-rolled products.
Figure 12:
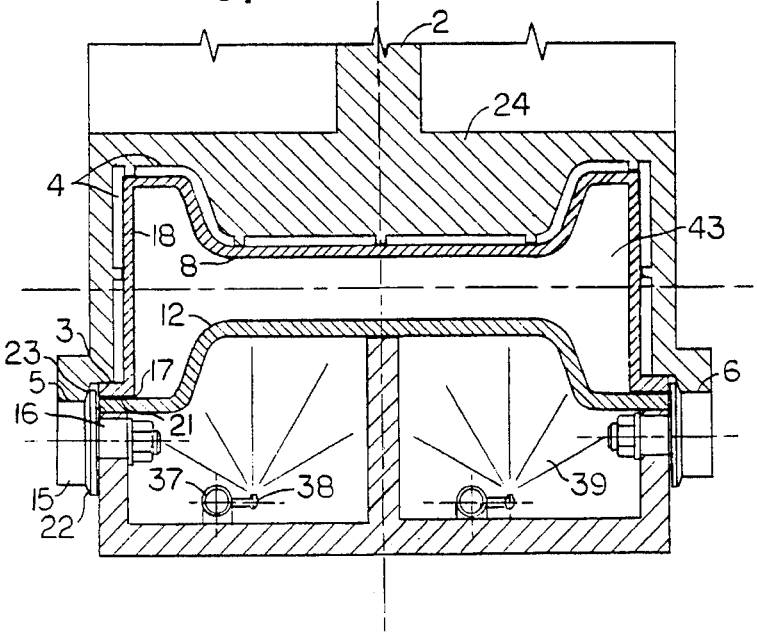
Figure 10:
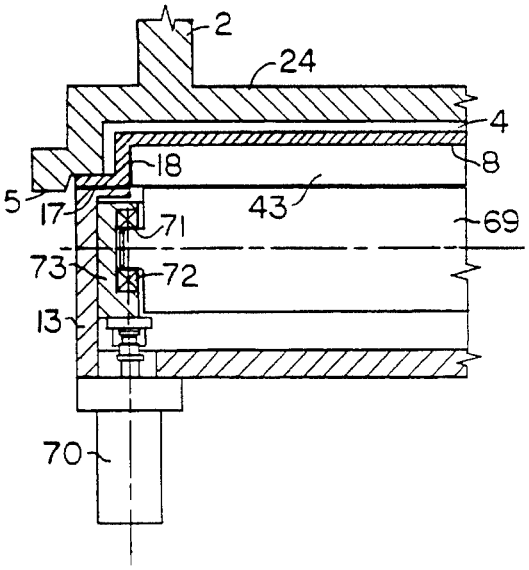
Figure 11:
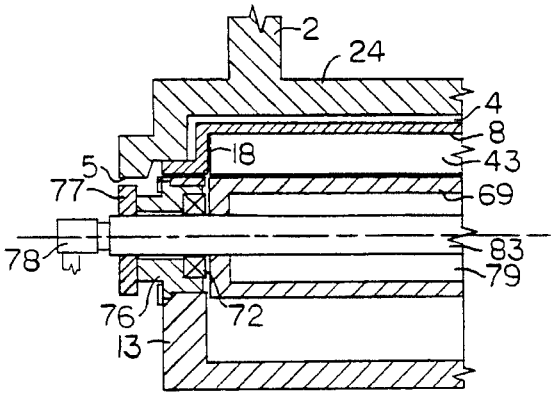
Figure 13:
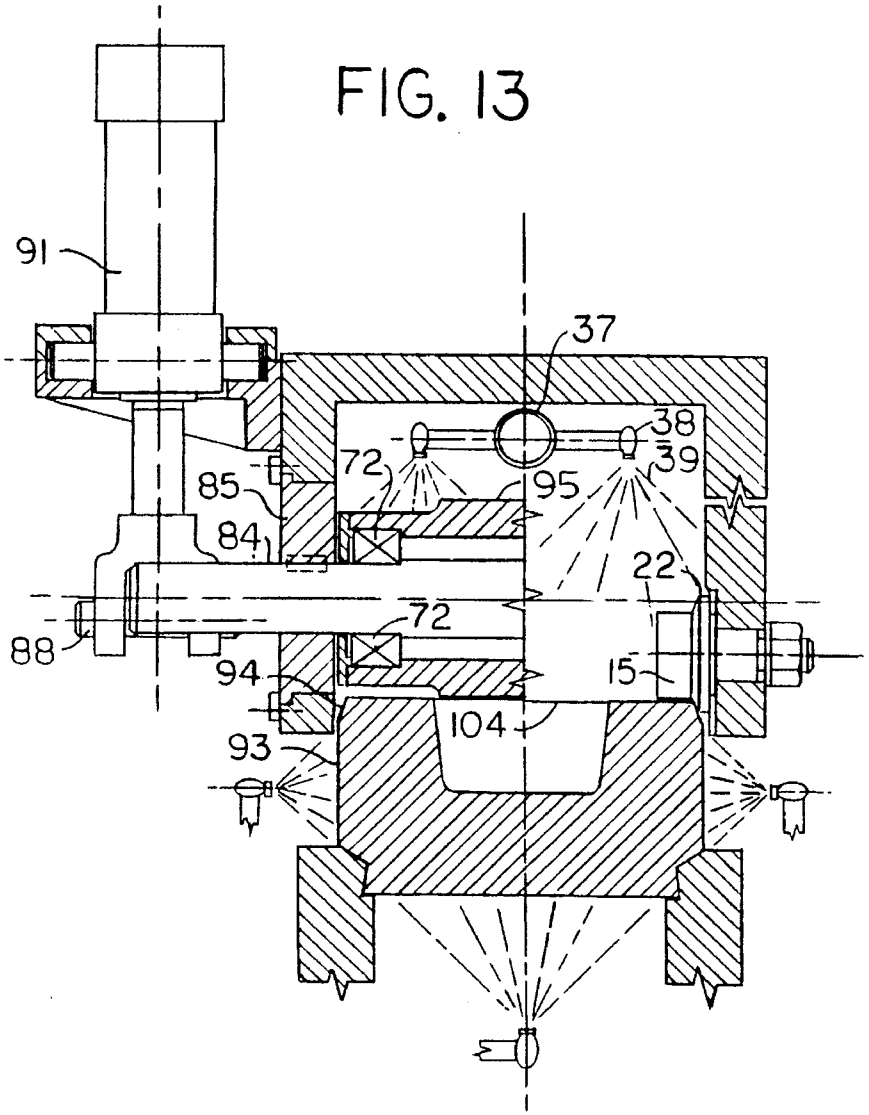
Figure 14:
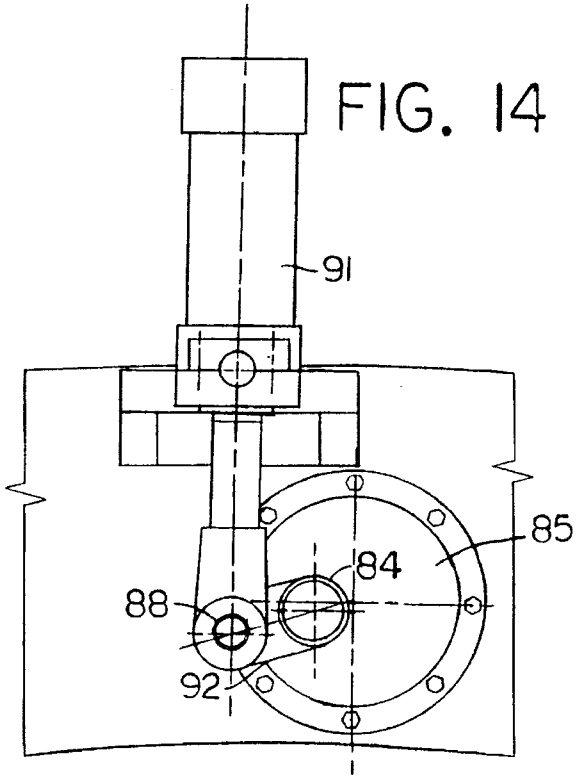
Figure 15:
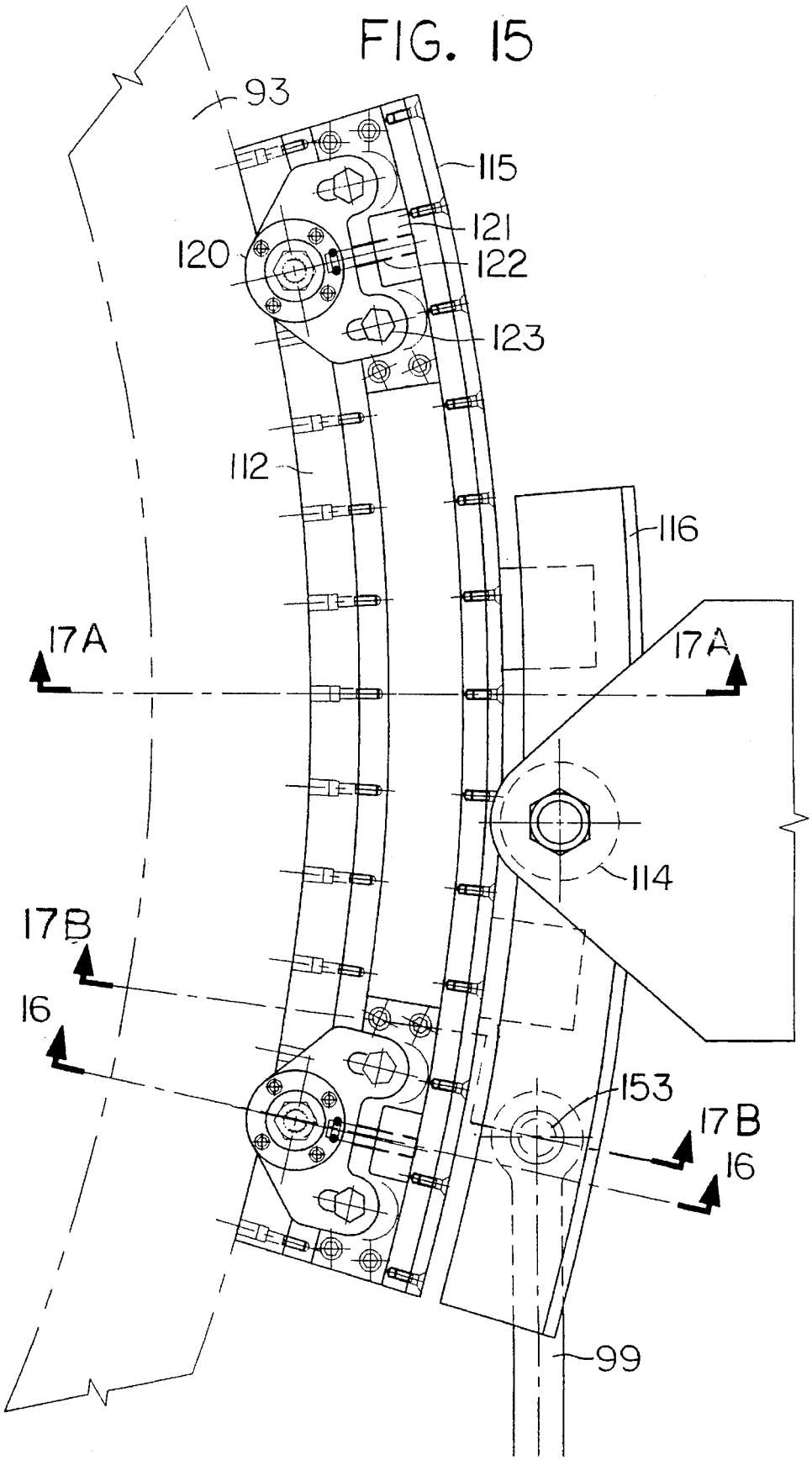
Figure 16:
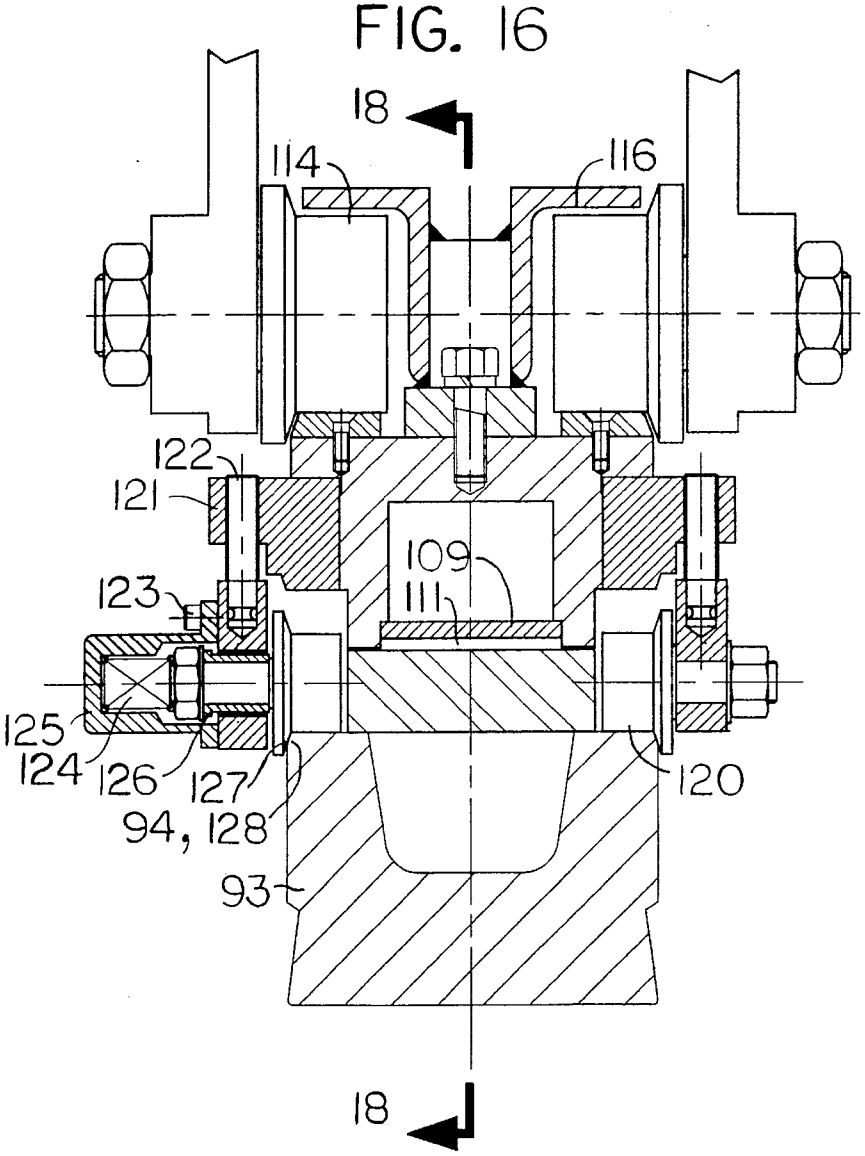
Figure 17A:
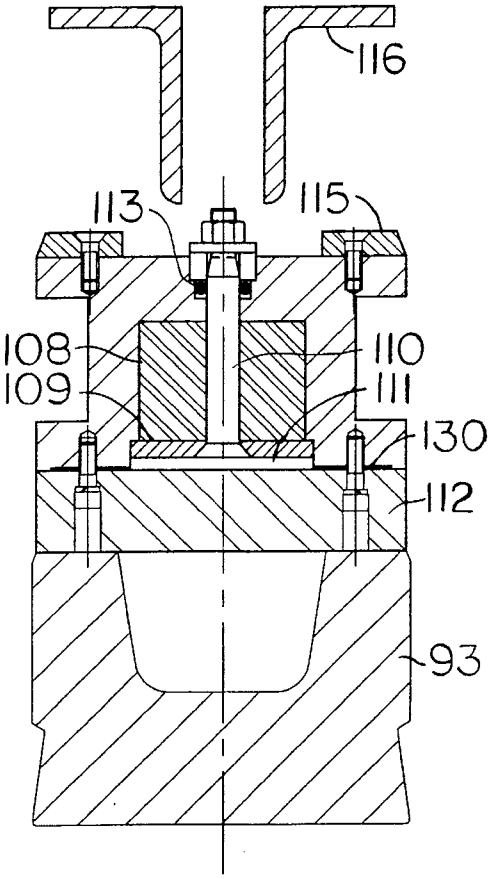
Figure 17B:
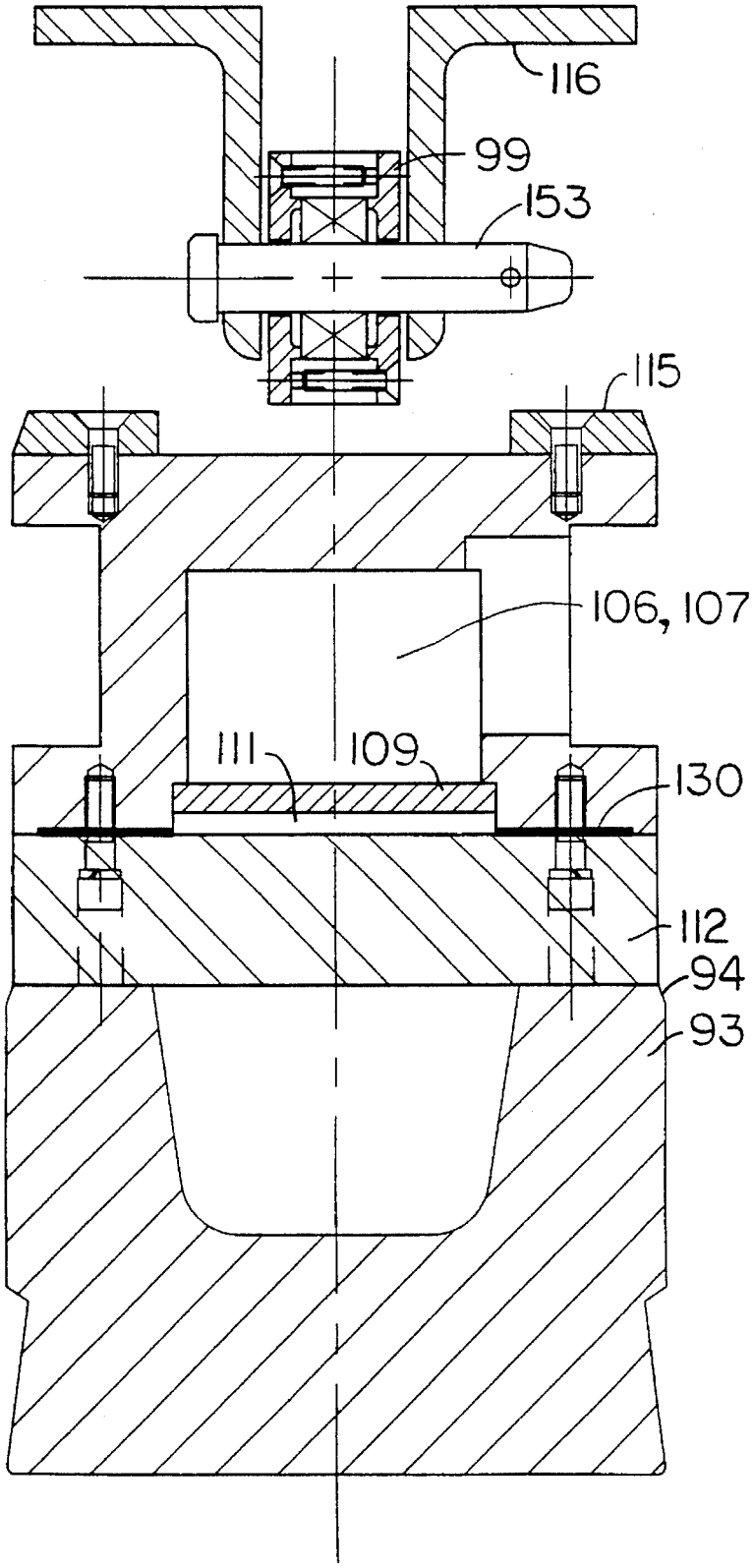
Figure 18:
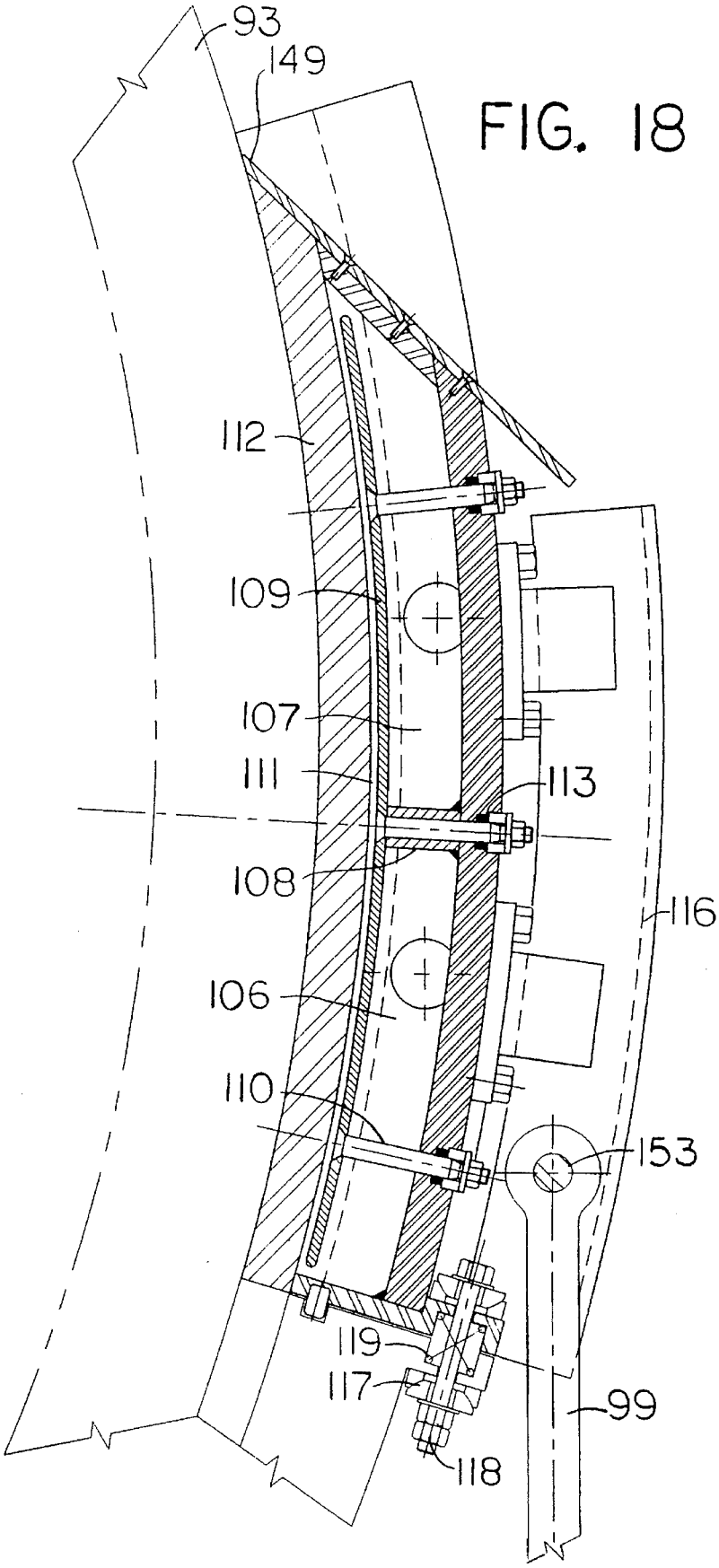
Figure 19:
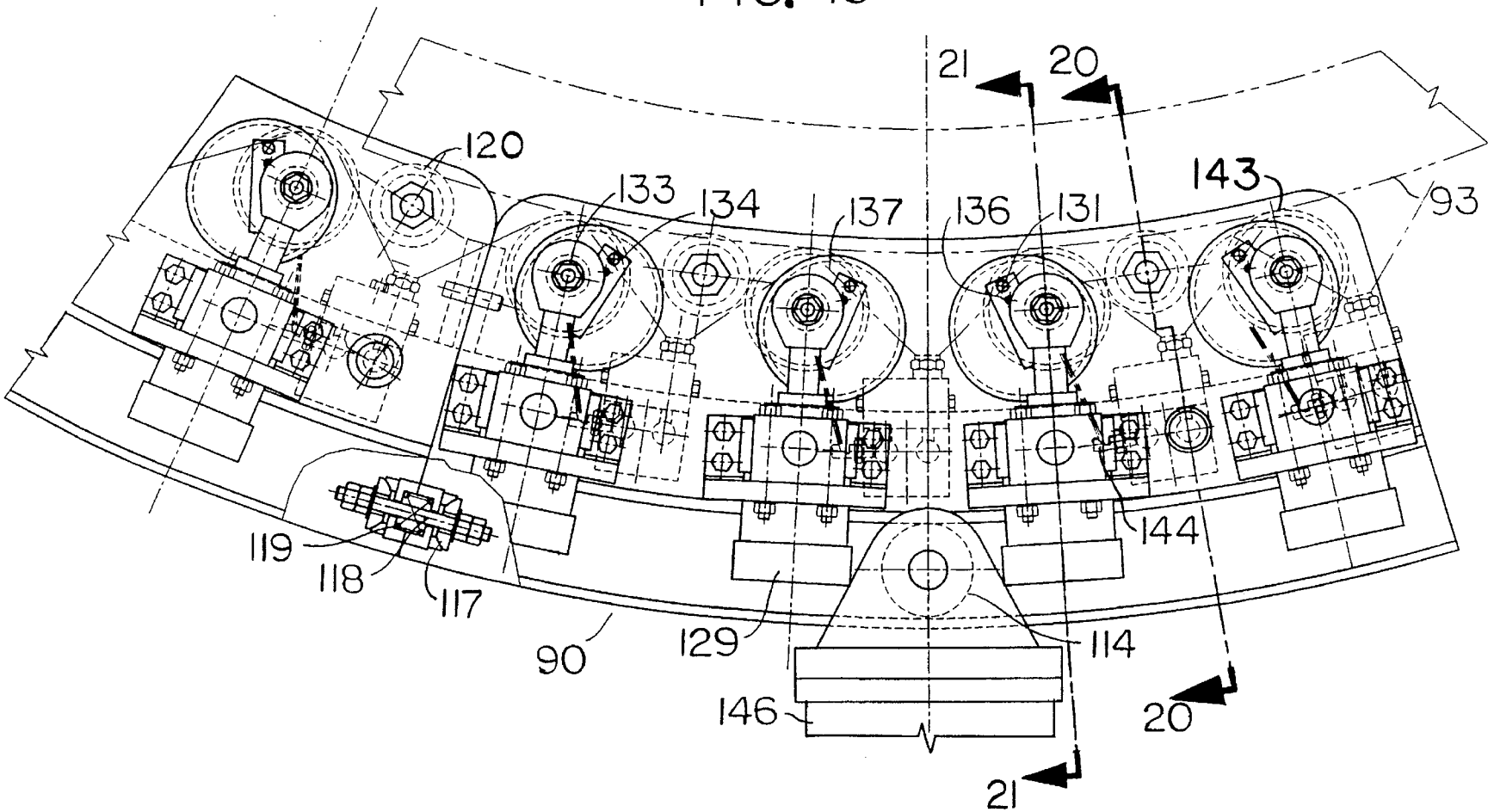
Figure 20:
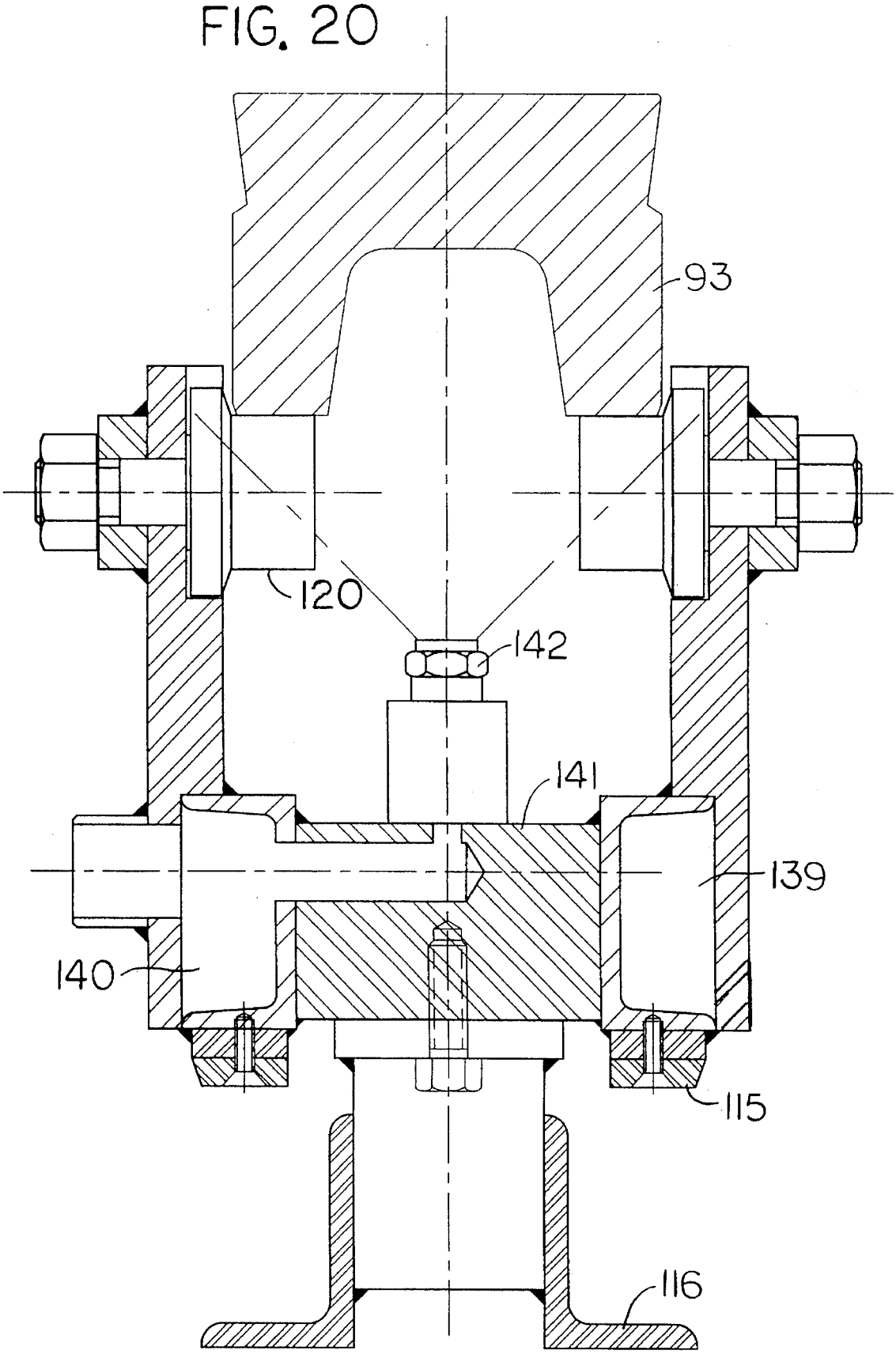
Figure 21:
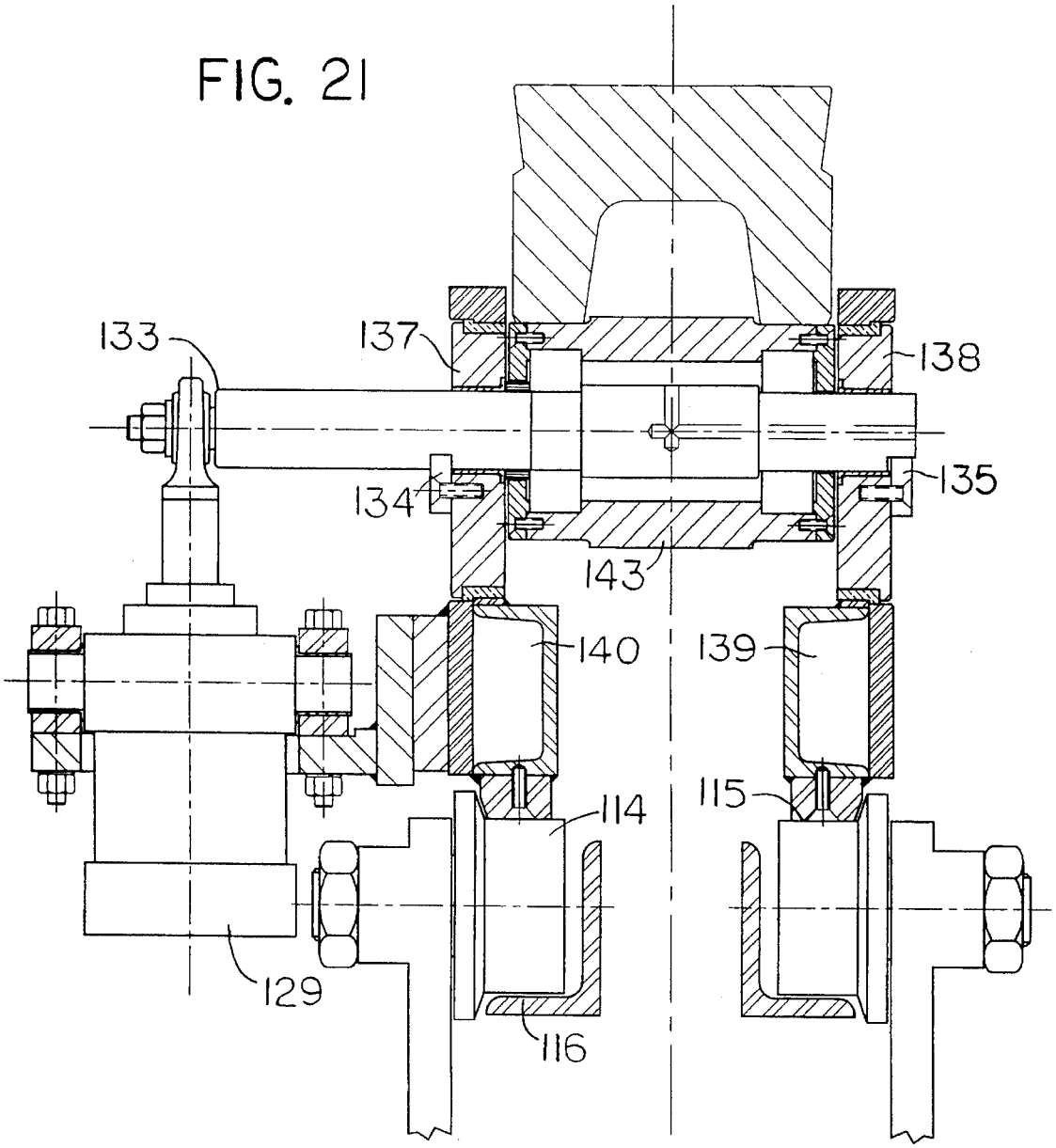

FIGS. 10, and 11 illustrate two variations for containment idler roller bearing support, positioning and pressure application;

FIG. 12 is a corresponding section view of that illustrated in FIGS. 2 and 5, incorporating a mold cavity adapted for the near net shape casting of structural sections and the like;

FIG. 13 is a split cross-section illustration of a containment roller segment embodiment;

FIG. 14 is a partial side view of the roller segment of FIG. 14;

FIG. 15 is a side elevation view of an entry mold segment assembly;

FIG. 16 is a section view along plane 16—16 of FIG. 15;

FIG. 17A is a section view taken along line 17A—17A of FIG. 15;

FIG. 17B is a section view taken along line 17B—17B of FIG. 15;

FIG. 18 is a section view along plane 18—18 of FIG. 16;

FIG. 19 is a side elevation view of a containment roller segment assembly incorporating four containment rollers;

FIG. 20 is a section view along plane 20—20 of FIG. 19;

FIG. 21 is a section view along plane 21—21 of FIG. 19; and

Figure 22:
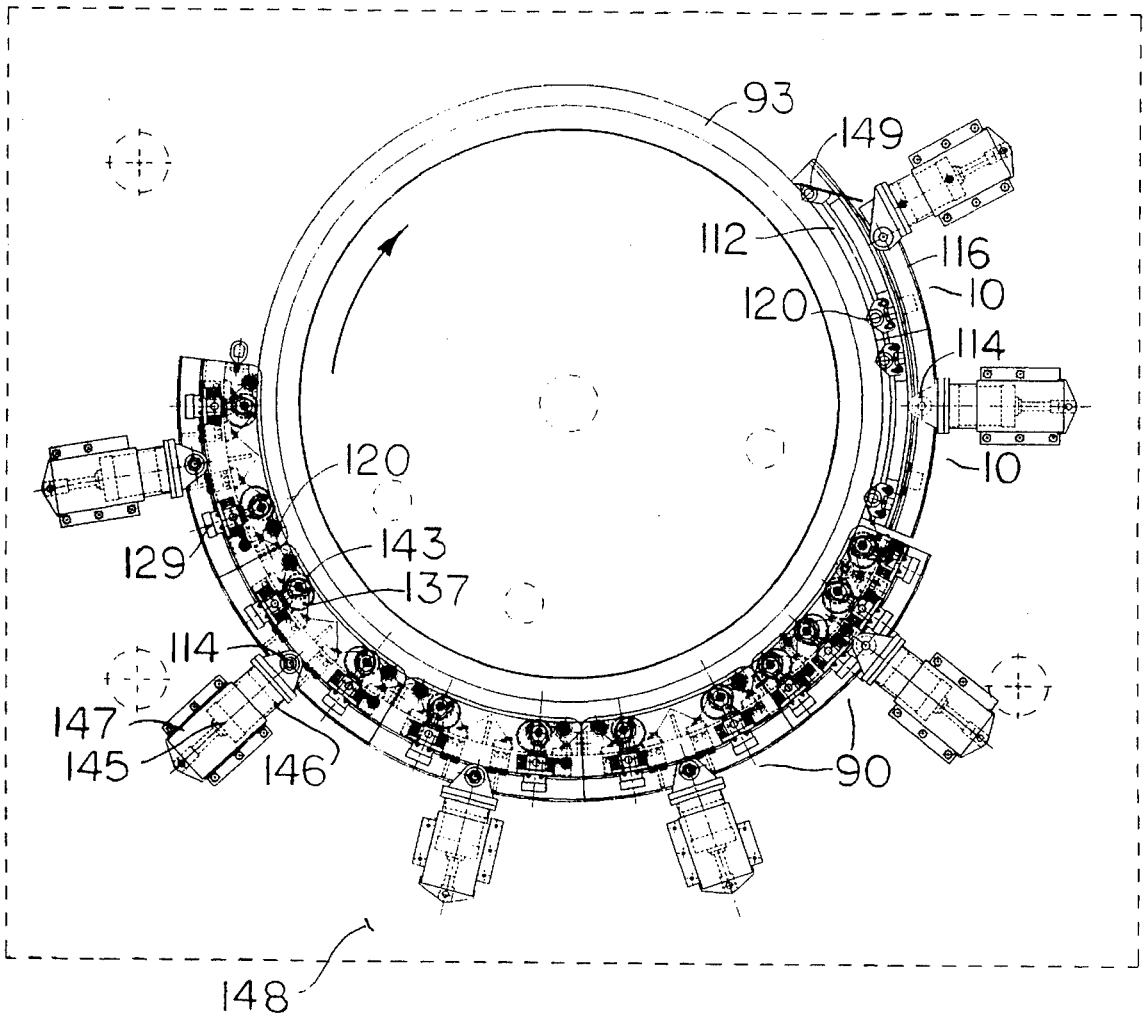

FIG. 22 is a front elevation general arrangement view of the principal elements of a mold closure apparatus according to the invention.

Figure 23:
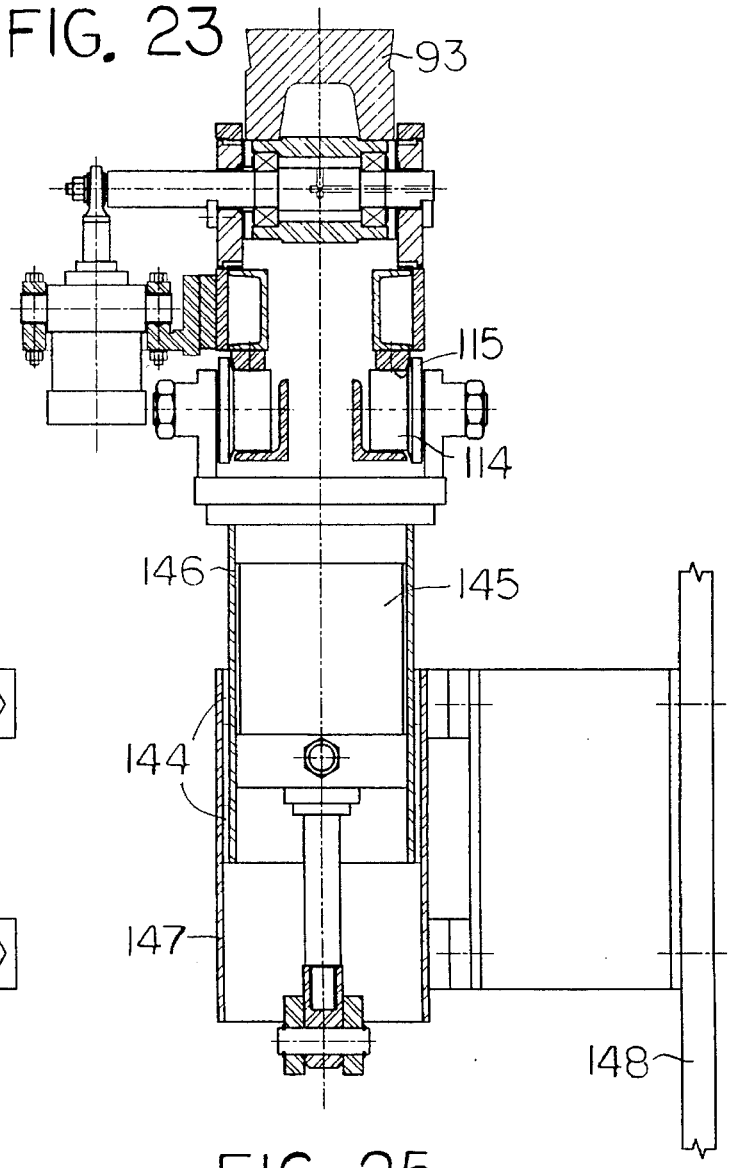
Figure 24:
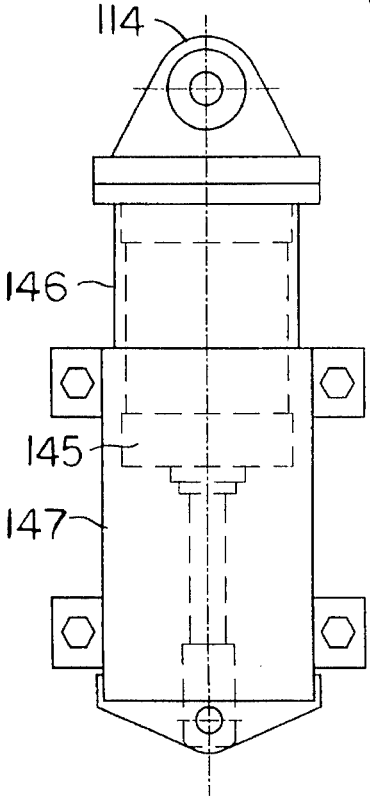
Figure 25:
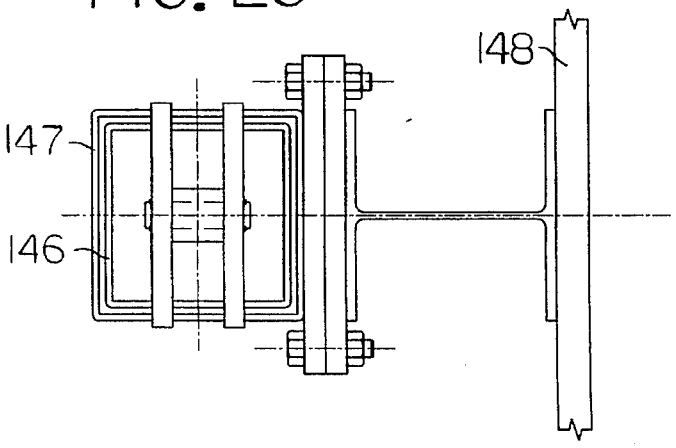

FIGS. 23, 24 and 25 illustrate details of an externally supported balancing assembly as shown in FIG. 22.

Figure 26:
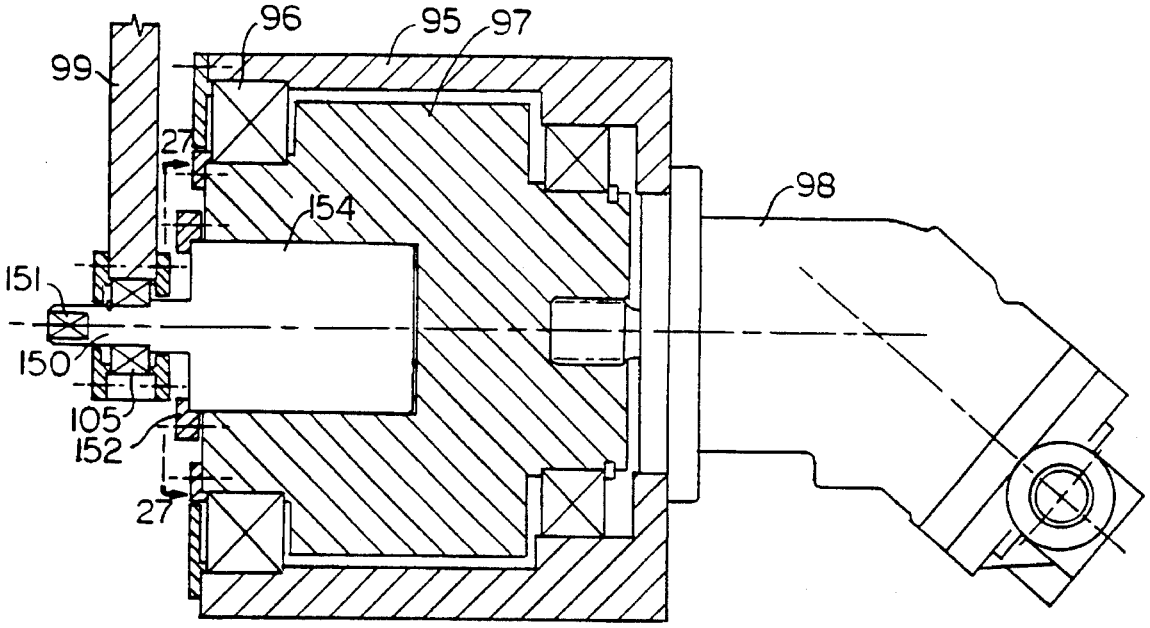
Figure 27:
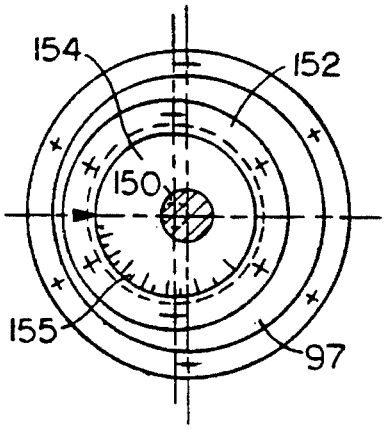

FIG. 26 is a section view of a suitable segment oscillator assembly;

FIG. 27 is a section view along plane 27—27 of FIG. 26.

Referring to the drawings, wheel hub assembly 1, is journalled upon beatings mounted on fixed supports and the rotated by an appropriate electro-mechanical or hydraulic drive unit, preferably at variable and controlled speed. In the embodiment illustrated, the rotary wheel structure comprises a solid-disc body 2 with radial stiffener ribs 19 spanning between hub 1 and U-shaped wheel rim 24, also defining cooling water jacket annulus 4. A typical wheel size would be 2–4 meters in diameter, although a wide range of sizes are possible. It is to be appreciated that a substantial part of the drawings are diagrammatic only, particularly regarding aspects known in the art. Wheel mold cooling water is introduced, and spent water discharged, via appropriate rotary union assemblies incorporated into hub assembly 1, supplied to and returned from wheel rim 24 via appropriate wheel mounted water pipes 35. The details of this aspect and numerous other features of the wheel casting machine are not shown or described herein, being well known in the art, and with many known and obvious options as to selection and configuration available.

Casting wheel rim 24 carries annular inner radius mold-wall support rings 3 and also two outer-radius mold-wall edge guide tracks 5, 6 comprising cylindrical radial surfaces, directed radially outward, one on either side of axial central plane of rotation 7 of the inner radius mold wall, in the embodiment illustrated. The inner radius mold-wall 8 may also include side faces 18 extending radially outwards, as in the embodiment illustrated for casting of a square cross section, approximately at right angles to the inside face of mold wall 8. The mold wall usually of copper or copper alloy, fastened to support rings 3 such as by screws spaced around the wheel rim periphery. On most casting heels, side faces 18 are tapered to diverge transversely outwards, for example, at a slope of 1 or 2 per cent, thereby assuring clearance for tangential discharge of the cast section at exit 20, without edge friction or binding between the section and side faces 18.

Non-rotating casting mold segment 11 incorporates outer radius mold-wall 12 as its inner face thereby forming a casting mold envelope 43 between said inner and outer mold walls. It may comprise a single rigid section or be made up in multiple sections. In the embodiment illustrated, segment 11 comprises three rigid semicircular box enclosures 10 having the abutting end of box side walls 13 interleaved and connected together by hinge pins 14. Each box enclosure 10, in turn, has two cam track followers 15 mounted on each side wall 13, positioned to run in contact with guide tracks 5,6. Appropriately, the roller mounting studs incorporate eccentric bushings 16, to enable easy adjustment of the clearance 17 between the interfacing inner 19, and outer 21, parallel annular mold-wall edges. Adjustment of these clearances, in the embodiment illustrated, may be effected manually using an Allen wrench applied to a hexagonal socket in the stud end of cam roller 15, whilst measuring the clearances with feeler gauges. Clearances down to the 25 micron area can be accomplished without any contact across the interface, thus emulating a continuous mold wall whilst avoiding wear and galling of these mating surfaces. At typical casting temperatures approaching the liquidus, the combined parameters of surface tension, viscosity and transient solidification in the presence of cold, high-conductivity mold wall material, generally then preclude entry of metal between the mold-edge faces proximate the meniscus. The rollers are also provided with flanges 22 to ride against circumferential transverse alignment guide surfaces 23, incorporated into guide tracks 5,6 to maintain transverse (side-to-side) outer mold-wall alignment. Segment-mounted radially-slidable brackets, or the like, of course may be employed to augment, or as alternatives to, the eccentric bushings 16 for adjustment of track follower position and thereby clearance 17. Outer-radius mold wall 12 may be contoured, for example, recessed between the edges to provide a rounded billet corner and eliminate the sharp right-angled corner at 17 characteristic of a flat plate shoe, a source of possible rolling mill difficulty.

In order to hold each box enclosure 10 in place and assure continuous contact of cam rollers 15 with guide tracks 5, 6 during the course of rotation and application of pressure from the stock section being cast, the inner mold-wall support rings 3 also include a second set of annular balancing guide tracks 25 directed radially inwards, against which ride balancing cam followers 27. In the embodiment illustrated, there is one set comprising two of these rollers 27 applied to each hinged box enclosure 10, each set counter-acting the corresponding two sets of rollers 15, leveraged to apply approximately equal force to each set. The rollers 27 are mounted on balancing slide arm 29, guided for movement in the radial direction only within support ring side bracket 30, and stroked by balancing cylinder 31. Such balancing actuators can be powered by any appropriate fluid, but compressible gases such as air have a clear advantage when in a pressure-control mode of this application, by compensating for wheel and track eccentricity and irregularity displacements without use of supplementary proportional or servo control valves or the like to meter fluids back and forth. Oscillation of box enclosure 10 along the path defined by cam rollers 15 along tracks 5,6 is effected, such as by hydraulic oscillator 32 acting between rotatable bracket 33 fixed to box enclosure 10 and externally fixed support bracket 34. A wide range of forms of hydraulic and electro-mechanical oscillators as well as casting control systems, are known in the art of continuous casting and therefore not covered herein.

The inner mold walls are appropriately force water-cooled with water supplied and returned via at least one set of wheel-mounted water pipes 35. Each box enclosure 10 is supplied with coolant, usually water, via an inlet through box side walls 13 or outer cover wall 9 into enclosed header pipe 37 feeding coolant spray nozzles 38 which direct the coolant spray 39 to impinge on the exterior surface of outer radius mold-wall 12. Spent coolant flows by gravity through outlets 40 into appropriate hosing to a sump or the like, usually for recirculation. Ease of coolant enclosure, as compared to flexible belt casters, is also to be noted. In operation, to minimize sliding frictional contact between the stock surfaces and outer-radius mold-wall 12, coolant flow rates are generally adjusted to transfer heat from inner-radius mold-wall 8 faster than outer-radius mold-wall 12, thus favoring close contact with wall 8, rather than wall 12. Removable cover plates 41 incorporated in box enclosures 10 provide access to the sprays for maintenance and the like, as well as rotation adjustment of cam roller eccentric bushings 16. These preferably include quick-release fasteners and seals.

Start-up and operation are conducted in essentially the same manner as a conventional flexible-belt machine, molten metal being poured from tundish 36 into the entry end 42 of mold envelope 43 and the cast metal section withdrawn from the exit end 20 by means of powered withdrawal rollers 26 details omitted as well-known.

Figure 3:
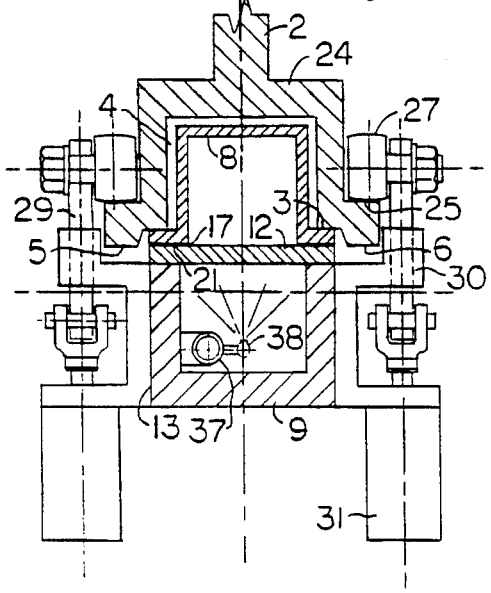
FIG. 3 is a section view along plane 3—3 of FIG. 1.
Figure 4:
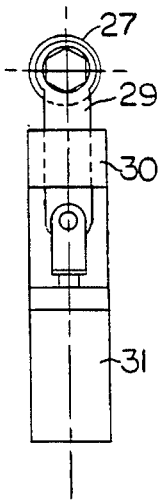
FIG. 4 is a side view of the apparatus illustrated in FIG. 3.

FIG. 5 illustrates an embodiment adapted for casting of thin slab products. Except for the shape and size of the mold envelope, it will be seen that the basic machine features are essentially the same as those for casting billets and blooms, as illustrated by FIGS. 2 and 3.

Figure 7:
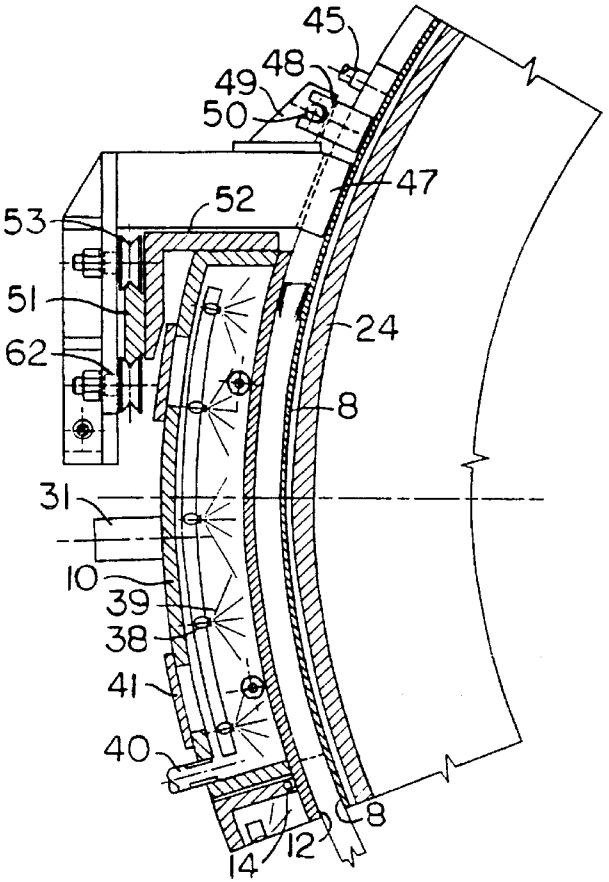
FIG. 7 is a sectional view along plane 7—7 of FIG. 6.
Figure 6:
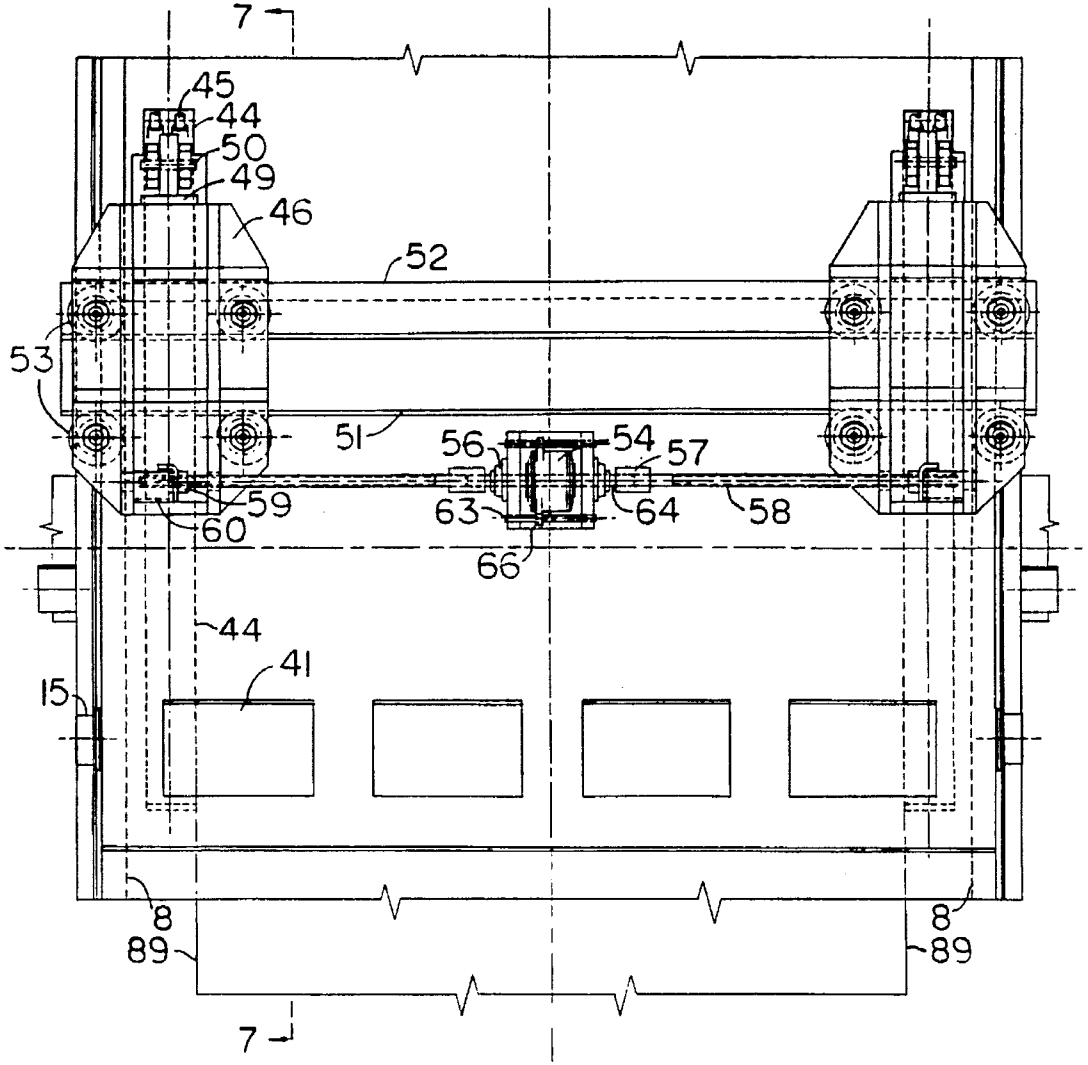
FIG. 6 is a partial front elevation view of a mold-width adjustment mechanism adapted for casting various flat-rolled product widths without changing the wheel mold.

Illustration FIGS. 6 and 7 show a supplementary apparatus to facilitate the casting of various slab widths without major equipment modifications or substitutions. Rather than confinement of the cast section between side faces 18 of the inner radius mold wall, the side faces 89 of partially solidified thin slab 61 are confined between the two movable mold side-dam bars 44, also fabricated and machined on an arc to a clearance fit between inner 8 and outer 12 mold wall faces. Bars 44 are confined transversely between side alignment brackets 47 of movable carriage 46, and circumferentially by the interaction between pin 50, as fixed to carriage 46 by bracket 48, and mold side-dam oscillator bracket 49. Carriage 46 is carried on two pairs of vee-guide rollers 53 while run on transverse guide track 51, providing linear guided movement only in the transverse direction. Track 51, in turn, is fastened to track support bracket 52 attached to box enclosure 10, and thereby transmits the corresponding circumferential oscillation movement of the outer mold wall to mold side-dam bars 44.

Rollers 53 are preferably mounted on eccentric bushings 62, providing for easy and accurate adjustment of alignment and clearance with guide track 51. By providing a close fit between side brackets 47 and bar 44, these bushings also facilitate precise adjustment of the transverse slope of bars 44.

Carriages 46 are fixed transversely by threaded take-up nuts 59 riding on support bracket 60, variably positioned axially by rotation of opposite-hand threaded carriage drive screws 58, as driven by centrally located hydraulic traverse motor 54. As illustrated, this is a hollow-shaft motor mounted on splined drive shaft 64, as carried between flange bearings 56 of motor support bracket 55, in turn fixed to the outer wall of box enclosure 10. Torque couple-arms 66 act against torque pins 63 to prevent motor body rotation. Shaft 64, in turn, is connected at either end to drive screws 58 by couplings 57.

Mold side-dam bar 44 appropriately comprises a rectangular tube of copper alloy, blanked off at both ends, with coolant provided via flexible hoses connected into coolant inlet and outlet connections 45, one of which is internally piped to the bottom extremity of side-dam bar 44. The faces of bar 44 may also be drilled for lubricant ducts and outlets, to provide face lubrication, such as by rapeseed oil during operation.

During casting, it is well known that the stock cross-section progressively shrinks with cooling and solidification during its descent within the mold, and also that the outer layer of "skin" of the casting is effectively self-sealing once a continuous surface has been formed around the casting perimeter, unless stresses are present sufficient to create a rupture and associated "break-out" of molten metal. In conventional oscillating mold casters, substantially all of the withdrawal force is usually applied following discharge from a roller spray chamber, or as assisted by a selected few driven rollers within the spray chamber containment area. The forces are thus applied at a remote point from the solidifying section at mold exit, or a limited number of selected points along the casting length, relying on bar skin tension/compression strength between these points to maintain casting integrity. Because of the stresses this creates, a relatively thick frozen skin is necessary at mold exit, substantially limiting the maximum casting speed, to allow sufficient time for formation of this skin.

Figure 8:
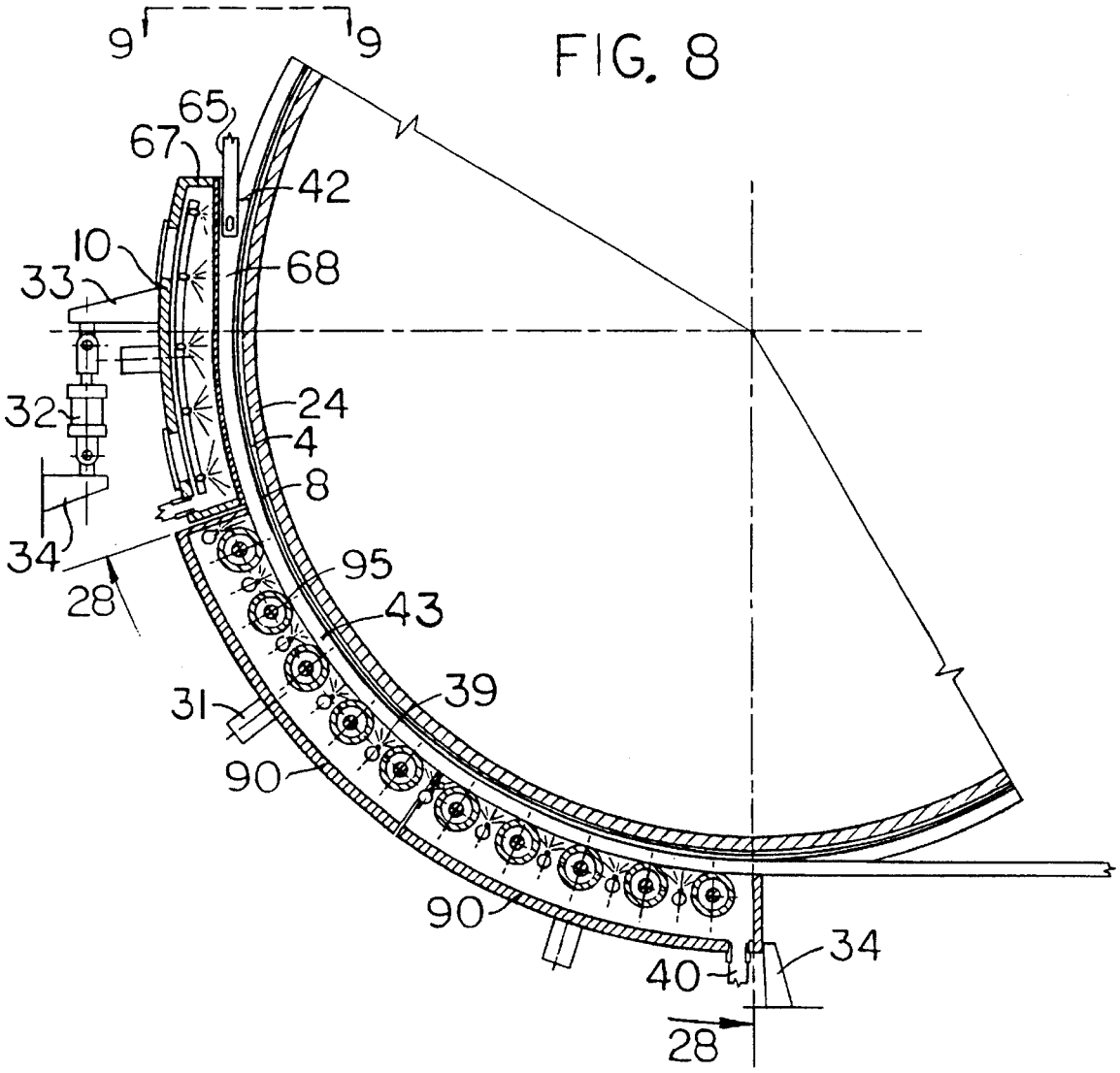
FIG. 8 is an illustrative partial sectional view of an alternative embodiment substituting containment idler rollers in place of the outer mold wall in the lower portion of the non-rotating casting sector.

Within the mold envelope, a taper can be added to the outer-radius mold walls 12 by graduating the portion of the face of outer-radius mold walls 12 within sides 18. In addition, FIG. 8 shows a variation including a containment roller wheel sector 28 incorporating containment roller segments 90 incorporating one or more box enclosures 10 which carry containment idler rollers 69, in place of outer radius mold-wall 12, with coolant sprays 39 thereby impinging directly upon the surface of the cast metal section. Along the are of wheel sector 28, the withdrawal forces can then be applied directly by the rollers 69 at the cross section being cast, by maintaining static frictional contact and pressure between the stock skin surface and the inner radius mold walls, as they move and propel the casting along at essentially identical surface speed. Tensional casting stress is thereby nearly eliminated, allowing a very substantial increase in practical casting speed for similar effective mold lengths. Since the casting wheel rotation is furnishing the propulsive force, the powered withdrawal rollers 26 are also usually superfluous.

It is obvious that minor leakage of spent cooling water can take place via clearances 17, in the absence of sealed contact between side walls 13 and outer-radius mold wall 12. A supplementary seal may be added to minimize this leakage (not illustrated). Suitable practice could provide on the order of a meter of wheel arc, e.g. one box enclosure 10 at the top, as illustrated, incorporating outer mold walls 12 and the two bottom enclosures 90 be equipped with rollers 69. It will also be obvious that only the top enclosure need be oscillated, as an option, since the mold walls 12 comprise the potential friction causing and skin rupturing component. In the art of wide steel slab casting, supplementary driven rollers are sometimes added at intervals along the containment arc to reduce skin stresses, a requirement obviated by this invention.

Figure 9:
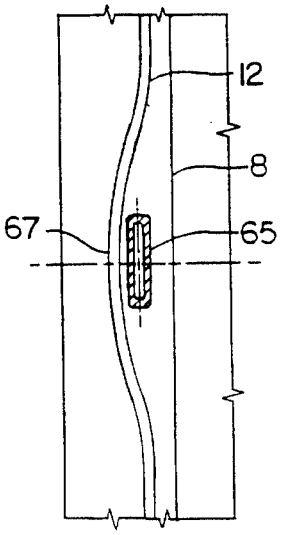
FIG. 9 is a partial top view along plane 9—9 of FIG. 8

One practical difficulty in the casting of this slab product is the desired narrow slab thickness in relation to the dimensions of submerged-entry shrouds. In FIGS. 8 and 9, it may be seen that the invention provides means to mitigate this problem by offering maximum benefit from a funnel-shaped departure on only the outer-radius mold wall at the shroud, where the wall is extended vertically and tangentially upwards, as at 67, at right angles to the wheel horizontal center line 80 in the plane of rotation of the wheel, at the transverse location of shroud 65, on either side of which the mold-wall is graduated into the straight-sided cylindrical wall, in the form of a half funnel-segment 68 with maximum width at the location of molten metal entry 42. In the embodiment illustrated, where the shroud thickness is nearly equal to the casting thickness, it may be seen that adequate insertion is obtained, including good wall clearance, by vertical shroud insertion parallel to this vertical funnel wall.

FIG. 10 illustrates simple means of maintaining position and controlled pressure of transverse containment rollers 69 against the outer section surface. The roller shafts 71 are journalled within sealed cartridge bearings 72, riding in guided chocks 73, as recessed in the structure of box side-walls 13. The chocks 73 and thereby rollers 69 are loaded and retracted by double-acting air or hydraulic cylinders 70, through which the force of each roller against the stock can be adjusted. Other arrangements, such as single-acting pistons, integral to the structure, with mechanical spring-return of the chock may of course be employed. The bearings should be well-cooled and maintained, to be close to frictionless, otherwise will longitudinally stress the casting skin.

FIG. 11 illustrates another means of supporting and controlling rollers 69, whereby the outer face of bearings 72, mounted on roll shaft 82, are carried within an eccentric bushing 76. Rotating means for this bushing, such as a pivotally mounted cylinder or rotary actuator (not shown) actuating lever arm 77 of the bushing, can effect both controlled pressure and controlled position of roller 69. Cooling water can also be supplied via rotary union 78 through internal ducting within shaft 83 to roll water cooling annulus 79. Advantages over arrangements such as FIG. 10 are optional position-control as well as pressure-control, and easier direct internal roll cooling.

As illustrated in FIG. 8, the containment idler rollers 69 are being applied to a thin slab, in which the relatively large diameter rollers shown are normally stiff enough when supported the ends only. For casting thick steel slabs and the like, closely-spaced "split" rollers of relatively small diameter are normally applied in the art of oscillating mold casters, which would require additional intermediate bearings supported on frame extensions of the containment roller-box enclosure.

FIG. 12 illustrates an embodiment in which the mold envelope is in the form of a near net shape structural beam blank. It will be evident that a variety of such mold shapes and sizes can be applied as variations on the basic features of the apparatus of the invention.

FIGS. 13 and 14 illustrate partial cross sections of a containment roller segment variation, in conjunction with a wheel in which a spray-cooled copper block mold ring 93 comprises the wheel rim, combining the functions of inner mold wall and annular outer radius mold wall edge guide track. Cam roller track followers 15 ride directly on the mold rim with flanges 22 riding against bevelled surface 94 of mold ring 93. Balancing rollers in this case may more conveniently be mounted to act between the roller segment and a fixed support attached to the machine base, backing frame or the like, rather than the rotating wheel. Roll shaft 84 is fixed, except for rotation together with externally eccentric bushing 85 keyed or otherwise fixed to shaft 84, and also concentrically supports the inner race of bearing cartridge 72 carrying roller 95 on the outer races. Pneumatic or hydraulic cylinders 91 function similarly to rotary actuators by stroking eccentric lever arm 92 to control position and pressure of containment rollers 95 against the outer surface 104 of the solidifying stock.

Lever arms 92 of adjacent rollers may also be linked together providing for actuation of two or more rollers with one cylinder, but with the potential disadvantage, in pressure mode, of unequal pressures or even stock-to-roller clearances occurring. In order to allow adjustable roll positioning in combination with a full retraction away from the wheel for maintenance and the like, a three-position duplex cylinder or equivalent may be employed in place of single cylinder 91. Alternatively, single cylinders with integral linear positions can be equipped to facilitate convenient, accurate positioning at intermediate strokes, as particularly desirable for those rollers immediately following stock exit from mold segment 10. Another positioning option is full stroke extension prior to commencement of casting, followed by a slow wheel rotation of the mold starter-plug with directional valves open, followed by valve closure, start of casting, and then transfer from the fixed positions to roll pressure control on all or a selected number of rollers.

FIGS. 15, 16, 17A, 17B and 18 illustrate additional or alternative embodiments of the mold segment apparatus. This includes a pressurized water-filled inlet chamber 106 separated from outlet chamber 107 by dividing wall 108, incorporating baffle plate 109, as held in position by drawbolts 110, to assure high-velocity water flow within annulus 111 for cooling of outer radius mold wall shoe 112. Drawbolts 110 are sealed by way of an appropriate O-ring gland 113. The outer radius mold wall shoes 112 are sealed by an elastomer-coated steel gasket 130 and fastened in position by screws 131. Among other features illustrated is a central mold overflow channel 149 at mold entry, to reduce the risk of molten metal jamming the entry junction between wheel and outer mold wall, should overflow conditions occur during casting. The balancing assembly is based upon an external support frame, to locate and control the force of flanged rollers 114 against balancing track 115. Rollers 114, in turn, are mounted with clearance but captured within retention flange 116, thus providing for retracting the segments radially outward and off the wheel to hold them in essentially fixed position when desired for mold inspection, maintenance, changing of wheels and the like.

This segment embodiment includes substantial radial adjustment of track followers 120, in view of the much lower cost of re-machining used outer radius mold wall shoes 112 after use; in comparison with replacement with new ones. Adjusting screw 122 effects adjustment of pillow blocks 121, to be held in position by locking screws 123. In order to avoid potential axial segment yawing and vibration, one of the followers 120 of each opposing pair is spring-preloaded transversely by way of compression spring 124 acting between cap 125 and the face of linear bushing 126, thus maintaining continuous running contact between flanges 127 and inner mold edges 128. Side-guide follower rollers, having one of each pair spring or fluid pre-loaded is a more elaborate alternative. A single universal hinge-coupling assembly connects adjacent segments together, comprising opposed spherical plain thrust bearings 117, adjustably confined by bolt-and-nut assembly 118 and incorporating pre-loading spring 119 adapted to eliminate clearances and any backlash, whilst allowing both transverse and angular misalignment between segments.

FIGS. 19, 20 and 21 illustrate additional or alternative embodiments of the box enclosure 10 roller segment apparatus 90. Pneumatic or hydraulic actuator 129 is pinned directly to containment roller shaft extension 133. Cross keys 134 and 135, as located by dowels 136, maintain rigidity and unified rotation of eccentrics 137 and 138, respectively. The assembly is adapted to provide combined air-water cooling via air manifold 139 and water manifold 140 feeding spray block 141 into air-most nozzles 142, as well as spray water only, onto rollers 143 via water nozzles 144. As shown, these segments are not enclosed, although they could be so arranged if desired. Segment-to-segment hinging and segment balancing assemblies are analogous to those of the mold segments, as illustrated.

Flexible band closure casting wheels commonly used for casting copper and aluminum billets and rods normally utilize a much larger sector of the wheel than those for steel, that is, most commonly, entry is at 1–2 o'clock and exit at 9–10 o'clock position, rather than 3 and 6 o'clock. FIG. 22 illustrates the invention as applied to such a wheel, and with segment balancing effected by an air cylinder 145, for example, having 6-inch diameter by 5-inch stroke, mounted within a 7-inch square tube 146, the extension of which carries the segment balancing rollers 114, and guided by sliding bearing pads 144 riding against the inner walls of 8-inch square tube 147 fixed to machine frame 148. FIGS. 23, 24 and 25 illustrate details of the segment balancing units as appropriately cantilevered out from a backing frame also supporting the main casting wheel hub and bearings. Please note piping and wiring and the like is omitted from FIGS. 15–22 for clarity.

Fast casting speeds require rapid mold closure oscillation, towards maintaining sufficient negative strip with minimal surface oscillation marks. FIGS. 26 and 27 illustrate suitable oscillator, in which housing 95 carries bearings 96 for rotation of drive shaft 97 by means of adjustable speed hydraulic motor 98. Eccentric crank extension 99 revolves around the center axis of shaft 97 carrying connecting rod drive bearing 105. In order to adjust the stroke length, location ring 154 of cantilevered stub shaft 150 is rotated by nut 151 and locked at the desired stroke length as indicated by the graduate index 155 by bolted locking plate 152. The crank extension may be connected directly to mold segment wrist pin 153. Thus, a sinusoidal reciprocating oscillation, of selected adjustable stroke length, is transmitted to the mold segments.

It will be appreciated that a rotary wheel casting machine has been described and illustrated and that modifications and variations may be made by those skilled in the art, without departing from the scope of the invention defined in the appended claims.

I claim:

1. A continuous casting machine comprising a rotary wheel incorporating a circumferential inner-radius mold wall with two parallel annular inner mold-wall edges, integral with the wheel rim;

a non-rotating casting-mold segment incorporating an outer-radius mold wall having two outer mold-wall edges which are parallel to, and interface with, said inner mold-wall edges, forming a casting mold envelope between said-inner and outer radius mold walls;

molten metal pouring means adapted for introducing molten metal proximate the entry end of said mold envelope to pass through in the casting direction of circular wheel rotation and at least partially solidify a cast metal section for exit from the exit end of said mold envelope;

external support means of said non-rotating segment adapted to maintain it in a substantially fixed angular position in relation to said wheel;

reciprocal oscillation means connected to said non-rotating casting-mold segment adapted to effect relative annular oscillation movement of said outer radius mold wall alternately in said casting and reverse directions in relation to said support means and thereby between said outer-radius mold wall and said solidifying cast metal section, in combination with:

at least one annular outer-radius mold-wall edge guide track integral with said rotary wheel proximate the wheel rim and which is parallel to said parallel mold-wall edges; and at least one guide track follower fixed to said non-rotating casting segment which is maintained in contact with said guide track during rotation of said wheel, adapted to maintain a substantially constant dimensional clearance between said inner-radius and outer-radius mold-wall edges.

2. A continuous casting machine according to claim 1 which includes two of said edge guide tracks, one located on either side of the central plane of rotation of said inner-radius mold wall, and also including at least two of said guide track followers for each of said guide tracks, and wherein said followers comprise cam roller followers adapted to run in contact with said tracks.

3. A continuous casting machine according to claim 1 which includes two of said guide tracks, one located on either side of the central plane of rotation of said inner-radius mold wall, and also including at least two of said followers for each of said guide tracks, and wherein said followers comprise cam follower rollers which run in contact with said track and incorporate means of restraining relative movement in the axial as well as radial direction of said rollers relative to said track and thereby between said inner and outer mold-wall edges during wheel rotation and in which the radial guide surfaces of each said guide track face radially outwards from the rotation axis of said wheel, and said cam follower rollers ride on these surfaces and thereby do not restrain said casting-mold segment from movement in the radially outward direction, wherein said wheel carries another annular balancing guide track with faces directed radially inwards complementary to each outward-facing track, against which rides at least one balancing cam follower attached to said non-rotating casting-mold segment thereby maintaining contact between said guide track followers and said guide track by radially restraining movement of said casting mold segment in the direction radially outwards from said wheel.

4. A continuous casting machine according to claim 1 wherein said non-rotating casting mold segment comprises at least one rigid, semicircular box enclosure having two box side walls, an outer cover wall, a top entry-end wall and a bottom exit-end wall, and a box inner wall carrying said outer-radius mold wall on its face;

coolant spray nozzles contained within said box enclosure directed radially inwards, and means for pressurized fluid coolant supply to said nozzles, thereby being adapted to spray liquid coolant directly against said outer-radius mold wall; and a gravity coolant exit duct proximate said bottom exit-end wall adapted for draining spent coolant from within said box enclosure.

5. A continuous casting machine according to claim 1 wherein said inner radius mold wall is integral with an annular casting wheel mold ring and said guide track comprises the annular rim of said mold ring.

6. A continuous casting machine according to claim 1 wherein said inner radius mold wall is integral with an annular casting wheel mold ring and said guide track comprises the annular rim of said mold ring, which includes coolant sprays directed to impinge radially outwards against the inside surface of said ring, adapted for removal of heat conducted radially inward through the body of said mold ring.

7. A continuous casting machine according to claim 5 or claim 6 which includes two of said edge guide tracks, each of which comprise opposite edges of said mold ring, one located on either side of the central plane of rotation of said inner-radius mold wall, and also including at least two of said guide track followers for each of said guide tracks.

8. A continuous casting machine according to claim 5 or claim 6, which includes two of said edge guide tracks, each of which comprise opposite edges of said mold ring, one located on either side of the central plane of rotation of said inner-radius mold wall, and also including at least two of said followers for each of said guide tracks, and wherein said followers comprise cam follower rollers which run in contact with said track and incorporate means of restraining relative movement in the axial as well as radial direction of said wheels relative to said track and thereby between said inner and outer mold-wall edges during wheel rotation and in which the radial guide surfaces of each said guide track face radially outwards from the rotation axis of said wheel, and said cam follower rollers ride on these surfaces and thereby do not restrain said casting-mold segments from movement in the radially outward direction, and external radial balancing means acting from a fixed support external to said wheel adapted to maintain contact between said guide track followers and said guide track by radially restraining movement of said casting mold segment in the direction radially outwards from said wheel.

9. A continuous casting machine according to claim 5 or claim 6, which includes two of said edge guide tracks, each of which comprise opposite edges of said mold ring, one located on either side of the central plane of rotation of said inner-radius mold wall, and also including at least two of said followers for each of said guide tracks, and wherein said followers comprise cam follower rollers mounted in pairs, one on each side of said wheel and adapted to press axially against said guide tracks which run in contact with said track and incorporate flanges restraining relative movement in the axial as well as radial direction of said wheels relative to said track and thereby between said inner and outer mold-wall edges during wheel rotation and in which the radial guide surfaces of each said guide track face radially outwards from the rotation axis of said wheel, and said cam follower rollers ride on these surfaces and thereby do not restrain said casting-mold segments from movement in the radially outward direction, and radial balancing means adapted to maintain contact between said guide track followers and said guide track by radially restraining movement of said casting mold segment in the direction radially outwards from said wheel, which includes an axial spring axially pre-loading one roller of each pair of said followers, thereby being adapted to eliminate axial clearance and prevent segment yawing or vibration during oscillation.

10. A continuous casting machine according to claim 1 which includes two of said guide tracks, one located on either side of the central plane of rotation of said inner-radius mold wall, and also including at least two of said followers for each of said guide tracks, and wherein said followers comprise cam follower rollers which run in contact with said track and incorporate means of restraining relative movement in the axial as well as radial direction of said rollers relative to said track and thereby between said inner and outer mold-wall edges during wheel rotation and in which the radial guide surfaces of each said guide each face radially outwards from the rotation axis of said wheel, and said cam follower rollers ride on theses surfaces and thereby do not restrain said casting-mold segment from movement in the radially outward direction which also includes a balancing assembly for said non-rotating segment comprising:

a support frame mounted on a fixed external support;

a movable carriage guided from said support frame carrying at least one balancing cam roller positioned to exert pressure radially inwards against an annular track integral to said segment and thereby maintain each said guide track follower pressed radially against said guide track during rotation of said wheel; and controlled radial pressure actuation means for said carriage adapted to adjust and maintain a controlled radial force of said balancing cam roller against said track during operation whilst allowing reciprocating annular oscillation of said segment.

11. A continuous casting machine according to claim 10 wherein said non-rotating segment includes at least one capture member of said balancing follower roller limiting its free movement radially outwards; and radical withdrawal means of said carriage and thereby of said segment and holding in a position clear of said wheel adapted for carrying out inspection and maintenance.

12. A continuous casting machine according to claim 1 carrying a radially outwardly-facing edge guide track, and a radially inward-facing balancing guide track on either side axially of said wheel rim, each parallel to said annular mold wall edges; and wherein the non-rotating casting-mold segment comprises a rigid box enclosure having two box side walls, a box outer cover wall and a box inner wall carrying said outer radius mold wall on its face;

four studded cam roller track followers, two of which are mounted to project outwardly from one side box side wall, one on either side of the transverse center line of said box, and two corresponding roller followers mounted in the opposite box side wall, to run in contact with said outwardly-facing guide track;

two balancing cam roller assemblies, one mounted on the outside of each box wall intermediate between said track followers, comprising a follower roller supported from said box enclosure and riding in contact with said inward-facing track, means for applying a continuous controlled pressure of said balancing follower roller against said track, sufficient to maintain said four cam roller followers in continuous contact with said outward-facing guide track during wheel rotation.

13. A continuous casting machine according to claim 12 wherein said means for applying a continuous controlled pressure of said balancing follower roller against said balancing guide track comprises a fluid-pressurized cylinder mounted on a bracket projecting axially from the box side wall, having a cylinder rod projecting radially inwards and the cylinder rod end carrying said balancing follower roller with its axis at right angles to the cylinder axis, thereby being adapted to apply a continuous and controlled force of said balancing roller against said inward-facing balancing guide track.

14. A continuous casting machine according to claim 12 wherein said cam roller guide track followers include a circumferential radially-projecting flange adapted to about a circumferential transverse alignment guide surface integral said wheel rim and also parallel to said mold-wall edges, thereby maintaining substantially constant transverse alignment between box enclosure and said wheel rim.

15. A continuous casting machine according to claim 12 wherein said non-rotating casting mold segment comprises a plurality of said box enclosures abutting end-wise, hinged together to present a substantially continuous outer mold wall through the arc of said non-rotating casting mold segment.

16. A continuous casting machine according to claim 1 in which said casting mold envelope has a rectangular cross section with longitudinal axis parallel to the axis of said rotary wheel adapted for casting of metal slab sections, which also includes two semicircular side-dam bars inserted into said mold envelope from said entry end, spanning between said inner and outer-radius mold walls, adapted to transversely confine the sides of said molten metal and partially solidified cast metal section within said mold envelope; also including means for width-adjustment of the transverse distance of separation between said side-dam bars and thereby the width of said section, which includes:

a transverse guide track fixed to said non-rotation casting mold segment;

two movable carriages supported on guide followers which run on said transverse guide track;

support means for said side-dam bars upon each of said carriages proximate the entry end of said mold envelope; and means for transverse positioning of said carriages along said track, thereby being adapted for adjusting the distance of separation said two side-dam bars according to the required width of said cast metal section.

17. A continuous casting machine according to claim 16, wherein said support means for said side-dam bar comprises transverse side alignment brackets between which the transverse faces of said side-dam bar is slidably confined;

a slotted hinge connection incorporating a slot allowing bracket self-centering movement in the radial direction, while preventing relative movement between said carriage and side-dam bar in the circumferential direction, thereby being adapted to oscillate said side-dam bar circumferentially in unison with said carriage and non-rotating casting mold segment, whilst allowing for side-dam radial self-alignment within said mold envelope.

18. A continuous casting machine according to claim 1, 2, 3, 4, 5, 6 or claim 10, wherein said non-rotating casting mold segment comprises at least one rigid, semicircular box enclosure having two box side walls, a box outer cover wall and a box inner wall carrying said outer-radius mold wall on its face, and in which said external support means and said oscillation means are attached to said box enclosure, thereby being adapted to oscillate said outer-radius mold wall back and forth in the circumferential direction about a substantially fixed angular location on the casting wheel periphery.

19. A continuous casting machine according to claim 1, 2, 3, 4, 5, 6, or claim 10 wherein said non-rotating casting mold segment comprises at least one rigid, semicircular box enclosure having two box side walls, a box outer cover wall and a box inner wall carrying said outer-radius mold wall on its face, and in which said external support means and said oscillation means are attached to said box enclosure, thereby being adapted to oscillate said outer-radius mold wall back and fourth in the circumferential direction about a substantially fixed angular location on the casting wheel periphery; and fluid coolant spray nozzles contained within said box enclosure directed radially inwards, and means for pressurized coolant supply to said nozzles adapted to spray coolant directly against said outer-radius mold walls.

20. A continuous casting machine according to claim 1, 2, 3, 4, 5, 6 or claim 18, which also includes a non-rotating containment-roller segment adjoining said exit end of said mold envelope, from which exits the partially solidified cast metal section, said containment-roller segment comprising at least one rigid semi-circular containment roller-box enclosure having two box side walls with inner edges parallel and adjacent to said wheel rim, with inner wall opening into the cavity bounded by said inner-radius mold wall;

a plurality of guide track followers mounted on said box side-walls, and maintained in contact with said edge guide track, adapted to maintain a substantially constant dimensional clearance between said inner edges of said side walls and the wheel rim;

transverse containment idler rollers journalled in bearings supported by said box side walls, with faces positioned and adapted to press radially inwards against the outer face of said cast metal section to maintain the inner face of said section pressed against said inner-radius mold wall, the tangential component of this pressure acting to exert a circumferential forward propelling force on said section in said casting direction; and fluid cooling means for the outer face of said cast metal section.

21. A continuous casting machine according to claim 1, 2, 3, 4, 5, 6 or claim 10, which also includes a non-rotating containment-roller segment adjoining said exit end of said mold envelope, from which exits the partially solidified cast metal section, said containment-roller segment comprising at least one rigid semi-circular containment roller-box enclosure having two box side walls with inner edges parallel and adjacent to said wheel rim, with inner wall opening into the cavity bounded by said inner-radius mold wall;

a plurality of guide track followers mounted on said box side-walls, and maintained in contact with said edge guide track, adapted to maintain a substantially constant dimensional clearance between said inner edges of said side walls and the wheel rim;

transverse containment idler rollers journalled in bearings supported by said box side walls, with faces positioned and adapted to press radially inwards against the outer face of said cast metal section to maintain the inner face of said section pressed against said inner-radius mold wall, the tangential component of this pressure acting to exert a circumferential forward propelling force on said section in said casting direction;

an outside cover wall of said containment roller-box enclosure;

coolant spray nozzles contained within said cover-wall directed radially inwards, and means for pressurized liquid coolant supply to said nozzles, adapted to spray liquid coolant directly against said outer face of said section; and at least one discharge duct for spent coolant from within said roller box enclosure proximate its lower extremity.

22. A continuous casting machine according to claim 1, 2, 3, 4, 5, 6, or claim 10, which also includes a non-rotating containment-roller segment adjoining said exit end of said mold envelope, from which exits the partially solidified cast metal section, said containment-roller segment comprising at least one rigid semi-circular containment roller-box enclosure having two box side walls with inner edges parallel and adjacent to said wheel rim, with inner wall opening into the cavity bounded by said inner-radius mold wall;

a plurality of guide track followers mounted on said box side-walls, and maintained in contact with said edge guide track, adapted to maintain a substantially constant dimensional clearance between said inner edges of said side walls and the wheel rim;

transverse containment idler rollers journalled in bearings supported by said box side walls, with faces positioned and adapted to press radially inwards against the outer face of said cast metal section;

containment roller positioning means adapted to move said containment idler rollers in direction towards and away from contact with said outer face of said section; and containment roller pressure-adjustment means adapted for controlled adjustment of the amount of force exerted by said containment rollers against said cast metal section upon contact with said section, as required to maintain non-sliding frictional contact between the inner face of said section pressed against said inner-radius mold wall, the tangential component of this pressure acting to exert a circumferential forward propelling force upon said section in the casting direction.

23. A continuous casting machine according to claim 1, 2, 3, 4, 5, 6, or claim 10, in which said entry end and exit end of said mold envelope are respectively above and below the horizontal center line in the plane of rotation of said wheel, wherein a portion of said outer-radius mold wall extends substantially tangentially and vertically upwards from a point proximate said horizontal center line extending to said entry end, creating a funnel-shaped entrance into said mold envelope, adapted to provide increased clearance for the vertical insertion, juxtaposed with said outer-radius mold wall, of a submerged entry shroud from a position above said non-rotating casting mold segment.

24. A continuous casting machine according to claim 1, 2, 3, 4, 5, 6, or claim 10, in which said casting mold envelope has a rectangular cross section with longitudinal axis parallel to the axis of said rotary wheel adapted for casting of metal slab sections, which also includes two semicircular side-dam bars inserted into said mold envelope from said entry end, spanning between said inner and outer-radius mold walls, adapted to transversely confine the sides of said molten metal and partially solidified cast metal section within said mold envelope; also including means for width-adjustment of the transverse distance of separation between said side-dam bars and thereby the width of said metal section.

25. A continuous casting machine according to claim 1, 2, 3, 4, 5, 6 or claim 10 wherein said entry end of said mold envelope includes a metal overflow channel proximate the axial plane of said wheel having the entry invert of said channel at an elevation lower than the highest junction between said entry ends of said inner-radius and outer-radius mold walls.

26. A continuous casting machine according to claim 1, 2, 3, 4, 5, 6, or 10 which comprises at least two of said segments wherein adjacent segments are connected together by a universal hinge proximate the central plane of said wheel, said hinge comprising:

two externally-restraining spherical thrust bearings abutting flanges carried by each respective segment thereby limiting separation distance between said flanges;

and adjustable length bolt limiting separation distance between said thrust bearings; and a compression spring member between said flanges adapted for maintaining pressurized contact between the mating faces of said thrust bearing and between said bearing and said flanges during operation.

27. A continuous casting machine comprising a rotary wheel incorporating a circumferential inner-radius mold wall with two parallel annular inner mold-wall edges, integral to the wheel rim;

a non-rotating casting-mold segment incorporating an outer-radius mold wall having two outer mold-wall edges which are parallel to, and interface with, said inner mold-wall edges, forming a casting mold envelope between said-inner and outer radius mold walls;

molten metal pouring means adapted for introducing molten metal proximate the entry end of said mold envelope to pass through in the casting direction of circular wheel rotation and at least partially solidify a cast metal section for exit from the exit end of said mold envelope;

at least two annular guide tracks mounted proximate the wheel rim and rotating with the wheel, one track located on either side of the plane of rotation of said inner-radius mold wall;

a non-rotating containment-roller segment adjoining said exit end of said mold envelope, from which exits the partially solidified cast metal section, said containment-roller segment comprising at least one rigid semi-circular containment roller-box enclosure having two box side walls with inner edges parallel and adjacent to said wheel rim, with inner wall opening into the cavity bounded by said inner-radius mold wall;

guide track followers mounted on each of said box side-walls, which run in contact with said guide tracks, adapted to hold said containment roller segment in a substantially fixed radial position relative to said wheel rim and maintain a substantially constant dimensional clearance between said inner edges of said box side walls and the rotating wheel rim;

transverse containment idler rollers supported by said box side walls, with faces positioned and adapted to press radially inwards against the outer face of said cast metal section;

containment roller positioning means adapted to move said rollers in direction towards and away from contact with said outer face of said section; and containment roller pressure-adjustment means adapted for controlled adjustment of the amount of force exerted by said containment rollers against said cast metal section upon contact with said section, as required to maintain non-sliding frictional contact between the inner face of said section pressed against said inner-radius mold wall, the tangential component of this pressure acting to exert a circumferential forward propelling force upon said section in the casting direction.

28. A continuous casting machine according to claim 27 also comprising an outside cover wall of said containment roller-box enclosure;

coolant spray nozzles contained within said cover-wall directed radially inwards, and means for pressurized liquid coolant supply to said nozzles, adapted to spray liquid coolant directly against said outer face of said cast metal section; and at least one discharge duct for spent coolant from within said roller box enclosure proximate its lower extremity.

29. A continuous casting machine according to claim 27 or claim 28, wherein said containment idler rollers are fixed to a shaft coaxial with said rollers, said shaft carrying bearings journalled within circular bushings journalled, in turn, within each of said box side walls, with a common axis of said bushings eccentric to the axis of said shaft, and wherein said positioning means comprises an actuator adapted for rotary angular displacement of said bushings; and said pressure-adjustment means comprises torque-limiter means of the maximum torque exerted by said actuator for angular displacement of said bushings.

30. A continuous casting machine according to claim 27 or claim 28, wherein said containment idler rollers are mounted on bearings adapted for rotation about a shaft co-axial with said rollers, said shaft carrying rotationally fixed circular bushings journalled within each of said box side walls, with a common axis of said bushings eccentric to the axis of said shaft; and wherein said positioning means comprises an actuator adapted for rotary angular displacement of said shaft; and said pressure-adjustment means comprises torque-limiter means of the maximum torque exerted by said actuator for angular displacement of said shaft.

31. A continuous casting machine according to claim 27 or claim 28, wherein said containment idler rollers are mounted on bearings for rotation about a shaft coaxial with said rollers, and said shaft is carried by chocks adapted for movement in the radial direction within parallel surfaces integral to said box side walls, and wherein said positioning means comprises fluid pressurized cylinders with rods connected to said chocks to stroke in the radial direction, said cylinders being integrally mounted upon said containment roller-box enclosure; and said pressure-adjustment means comprises controlled changing of the fluid pressure within said cylinders.

* * * * *